US008596334B2

(12) United States Patent
Miki et al.

(10) Patent No.: US 8,596,334 B2
(45) Date of Patent: Dec. 3, 2013

(54) CONTINUOUS CASTING METHOD FOR STEEL AND METHOD FOR MANUFACTURING STEEL SHEET

(75) Inventors: Yuji Miki, Fukuyama (JP); Takeshi Murai, Kurashiki (JP); Hiroyuki Ohno, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/583,487

(22) PCT Filed: Mar. 9, 2011

(86) PCT No.: PCT/JP2011/056122

§ 371 (c)(1),
(2), (4) Date: Nov. 14, 2012

(87) PCT Pub. No.: WO2011/111858

PCT Pub. Date: Sep. 15, 2011

(65) Prior Publication Data

US 2013/0233505 A1 Sep. 12, 2013

(30) Foreign Application Priority Data

Mar. 10, 2010 (JP) ..... 2010-053869
Mar. 10, 2010 (JP) ..... 2010-053870

(51) Int. Cl.
*B22D 11/115* (2006.01)

(52) U.S. Cl.
USPC ..... 164/466; 164/468

(58) Field of Classification Search
USPC ..... 164/466–468
See application file for complete search history.

(56) References Cited

U.S. PATENT DOCUMENTS

| | | | | |
|---|---|---|---|---|
| 8,376,028 | B2 * | 2/2013 | Miki et al. | 164/466 |
| 8,397,793 | B2 * | 3/2013 | Miki et al. | 164/466 |
| 2004/0182539 | A1 * | 9/2004 | Yamane et al. | 164/466 |
| 2006/0102316 | A1 * | 5/2006 | Itoyama et al. | 164/466 |

FOREIGN PATENT DOCUMENTS

| | | | |
|---|---|---|---|
| JP | 3142049 | A | 6/1991 |
| JP | 5077007 | A | 3/1993 |
| JP | 10305353 | A | 11/1998 |
| JP | 2003205349 | A | 7/2003 |
| JP | 2003251438 | A | 9/2003 |
| JP | 2005152954 | A | 6/2005 |
| JP | 2008200732 | A | 9/2008 |
| JP | 4569715 | B1 | 10/2010 |

OTHER PUBLICATIONS

International Search Report dated Apr. 26, 2011, application No. PCT/JP2011/056122.

* cited by examiner

*Primary Examiner* — Kevin P Kerns
*Assistant Examiner* — Kevin E Yoon
(74) *Attorney, Agent, or Firm* — RatnerPrestia

(57) ABSTRACT

In a method for continuously casting an extremely low carbon steel using a continuous casting machine, by adjusting the chemical components of extremely low carbon steel within a specified range by taking into account an interface tension gradient in a concentration boundary layer on a front surface of a solidified shell, and also by optimizing intensities of the DC magnetic fields applied to the upper magnetic poles and the lower magnetic poles respectively corresponding to a slab width of a slab to be casted and a casting speed, it is possible to acquire the slab having high quality not only with the small number of defects caused by the entrainment of bubbles, non-metallic inclusion and a mold flux into the molten steel.

23 Claims, 8 Drawing Sheets

CONTINUOUS CASTING METHOD FOR STEEL AND METHOD FOR MANUFACTURING STEEL SHEET

CROSS REFERENCE TO RELATED APPLICATION

This application is the U.S. National Phase application of PCT International Application No. PCT/JP2011/056122, filed Mar. 9, 2011, and claims priority to Japanese Patent Application Nos. 2010-053869, filed Mar. 10, 2010, and 2010-053870, filed Mar. 10, 2010, the disclosure of each of which are incorporated herein by reference in their entireties for all purposes.

FIELD OF THE INVENTION

The present invention relates to a continuous casting method for steel which produces a slab by casting molten steel while controlling the flow of the molten steel in a mold by an electromagnetic force, and a method for manufacturing a steel sheet by using the slab produced by casting using the continuous casting method.

BACKGROUND OF THE INVENTION

In the continuous casting of steel, molten steel charged into a tundish is poured into a mold for continuous casting through an immersion nozzle connected to a bottom portion of the tundish. In this case, a molten steel flow discharged into the inside of the mold from discharge holes of the immersion nozzle includes non-metallic inclusions such as alumina clusters and bubbles of an inert gas which is blown off from an inner wall surface of an upper nozzle (an inert gas blown off for preventing the clogging of the nozzle caused by adhesion or stacking of alumina or the like). When these non-metallic inclusions and bubbles are caught in a solidified shell, product defects (inclusion-caused defects, bubble-caused defects) occur. Further, a mold flux (mold powder) is entrained into an upward molten steel flow which reaches a meniscus so that the mold flux is also caught in the solidified shell leading to defects of a product.

Conventionally, to prevent the non-metallic inclusions, mold flux and bubbles in the molten steel from causing a product defect being caught in the solidified shell, a magnetic field is applied to a molten steel flow in the mold and the flow of molten steel is controlled by making use of an electromagnetic force generated by a magnetic field. Many proposals have been made with respect to this technique.

For example, Patent Document 1 discloses a method where a molten steel flow is braked by a DC current magnetic field which is applied to a pair of upper magnetic poles which is arranged to face each other with a mold long-side portion sandwiched therebetween and a pair of lower magnetic poles which is arranged to face each other with the mold long-side portion sandwiched therebetween. In this method, out of the molten steel flow which is divided into an upward flow and a downward flow after being discharged from discharge openings of the immersion nozzle, the downward flow is braked by a lower DC magnetic field and the upward flow is braked by an upper DC magnetic field thus preventing the non-metallic inclusions and a mold flux included in the molten steel flow from being caught in the solidified shell.

Patent document 2 discloses a method where a molten steel flow is braked by a DC current magnetic field which is applied to a pair of upper magnetic poles which is arranged to face each other with a mold long-side portion sandwiched therebetween and a pair of lower magnetic poles which is arranged to face each other with the mold long-side portion sandwiched therebetween in the same manner as Patent Document 1, and an AC magnetic field is applied to the upper magnetic poles or the lower magnetic poles in a superimposed manner. This method provides the braking of the molten steel flow by the DC magnetic field in the same manner as Patent Document 1, and also aims at the acquisition of a cleaning effect of non-metallic inclusions or the like on an interface of a solidified shell due to stirring of molten steel by an AC magnetic field.

Further, Patent Document 3 discloses a method where a molten steel flow is braked by a DC magnetic field which is applied to a pair of upper magnetic poles which is arranged so that the magnetic poles face each other with a mold long-side portion sandwiched therebetween and a pair of lower magnetic poles which is arranged so that the magnetic poles face each other with the mold long-side portion sandwiched therebetween respectively. In this method, the intensity of DC magnetic field and an intensity ratio between a DC magnetic field of the upper magnetic poles and a DC magnetic field of the lower magnetic poles are set to values which fall within specific numerical ranges.

Further, Patent Document 4, 5 disclose a continuous casting method where the catching of bubbles in a solidified shell can be suppressed by controlling a surface tension due to concentration gradient of C, S, N, O in molten steel on a front surface of the solidified shell, that is, by adjusting the concentrations of C, S, N, O in molten steel such that the surface tension becomes equal to or below a predetermined value.

PATENT LITERATURE

[Patent Document 1] JP-A-3-142049
[Patent Document 2] JP-A-10-305353
[Patent Document 3] JP-A-2008-200732
[Patent Document 4] JP-A-2003-205349
[Patent Document 5] JP-A-2003-251438

SUMMARY OF THE INVENTION

Along with the recent tendency that the requirement on quality of a steel sheet for a skin plate of an automobile becomes stricter, defects caused by entrainment of minute bubbles, minute non-metallic inclusions and a minute mold flux which had not been treated as problems are considered as problems now. The continuous casting method disclosed in Patent Documents 1 to 3 cannot sufficiently cope with such strict requirement on quality. Particularly, in manufacturing a hot-dip galvannealed steel sheet, after hot dipping, the steel sheet is heated so that an iron component in a base-material steel sheet is diffused into a galvanized layer and hence, a surface layer property of the base-material steel sheet largely influences quality of a hot-dip galvannealed layer. That is, when bubble-caused defects, inclusion-caused defects or mold-flux-caused defects are present in the surface layer of the base-material steel sheet and hence, irregularities occur in a thickness of a plated layer even when a defect is small, and these irregularities appear as stripe-like defects on a surface of the base-material steel sheet so that the steel sheet cannot be used in applications on which strict requirements of quality are imposed such as a skin plate of an automobile.

Further, in Patent Document 4 and in Patent Document 5, the catching of non-metallic inclusion such as alumina cluster by a solidified shell has not been studied at all. Further, although these documents suggest that the catching of the bubbles in the solidified shell is influenced corresponding to the composition of molten steel, the relationship between the catching of bubbles and flow velocity of molten steel at molten steel-solidified shell interface is not clarified and hence, the catching of the bubbles cannot be quantitatively grasped. This is because, in the inside of an actual mold, resistance attributed to flow velocity of molten steel works simultaneously with a surface tension (=catching force of the solidified shell) generated by a concentration distribution of C, S, N, O but also and hence, in studying the catching of bubbles and the non-metallic inclusions in the solidified shell, it is necessary to take into account the resistance by the flow velocity of molten steel at molten steel-solidified shell interface.

Accordingly, the present invention provides a continuous casting method for extremely low carbon steel which can overcome the above-mentioned drawbacks of the related art and can, by controlling a molten steel flow in a mold using an electromagnetic force, produce a slab having high quality not only with the small number of defects caused by non-metallic inclusions and a mold flux which have been considered as problems conventionally but also with the small number of defects caused by entrainment of minute bubbles, minute non-metallic inclusions and a minute mold flux.

Inventors of the present invention have studied various casting conditions at the time of controlling a flow of molten steel in a mold by making use of an electromagnetic force for overcoming the above-mentioned drawbacks. As a result of this study, the inventors have found that in a method for continuously casting extremely low carbon steel while braking a molten steel flow by a DC magnetic field applied to a pair of upper magnetic poles which is arranged to face each other with a mold long-side portion sandwiched therebetween and a pair of lower magnetic poles which is arranged to face each other with the mold long-side portion sandwiched therebetween respectively, the chemical component of extremely low carbon steel is adjusted within a specified range determined by taking into account an interface tension gradient in a concentration boundary layer on a front surface of a solidified shell, and intensities of DC magnetic fields applied to the upper magnetic poles and the lower magnetic poles respectively are optimized corresponding to a slab width of a slab to be casted and a casting speed so that molten steel in the mold can be brought into an appropriate flow state where non-metallic inclusions and bubbles are not caught in the solidified shell and no mold powder entrainment is generated whereby it is possible to produce a slab having high quality not only with small number of the defects caused by non-metallic inclusions and a mold flux which had been considered as problems conventionally but also with the small number of defects caused by minute bubbles, minute non-metallic inclusions and a minute mold flux. Further, the inventors have also found that to acquire the slab having high quality in such continuous casting, a nozzle immersing depth, optimum ranges exist with respect to a nozzle inner diameter of an immersion nozzle, a slab thickness and the like, and advantageous effects of the present invention can be realized most within the ranges.

By continuously casting the slab by controlling the flow of molten steel in the mold with DC magnetic fields applied to the upper magnetic poles and the lower magnetic poles respectively, mold-flux-caused defects caused by entrainment of a mold flux can be prevented, and also a defect caused by bubbles and non-metallic inclusions having a relatively large size (usually 1 mmϕ or more) can be prevented. However, in this continuous casting method, it is difficult to surely prevent the catching of more minute bubbles and minute non-metallic inclusions by a solidified shell and hence, there exists a possibility that a surface defect caused by the entrainment of such minute bubbles and minute non-metallic inclusions arises. To the contrary, by adjusting the chemical component of extremely low carbon steel within the specified range by taking into account the interface surface gradient in the concentration boundary layer of the front surface of the solidified shell and also by optimizing the intensities of the DC magnetic fields applied to the upper magnetic poles and the lower magnetic poles corresponding to the slab width to be cast and the casting speed, it is possible to suppress the catching of the minute bubbles and minute non-metallic inclusions in the solidified shell. Accordingly, the entrainment of the mold flux can be prevented, and also the catching of the bubbles and the non-metallic inclusions in the solidified shell can be prevented irrespective of sizes of the bubbles and the non-metallic inclusions and hence, it is possible to manufacture a steel sheet having high quality with extremely small number of surface defects caused by the entrainment of bubbles, the non-metallic inclusions and the mold flux.

It is also found that by applying pickling and cold rolling to a hot-rolled steel sheet obtained by rolling the slab produced by casting by the above-mentioned continuous casting method under specified conditions, a steel sheet having high quality with extremely small number of blisters can be manufactured.

The present invention has been made based on these findings, and the gist of the present invention according to exemplary embodiments is as follows.

[1] A continuous casting method for steel in which extremely low carbon steel containing 0.003 mass or less of C is continuously cast using a continuous casting machine where a pair of upper magnetic poles which is arranged so that the upper magnetic poles face each other with a mold long-side portion sandwiched therebetween and a pair of lower magnetic poles which is arranged so that the lower magnetic poles face each other with the mold long-side portion sandwiched therebetween are provided to an outer side of a mold, an immersion nozzle with a molten steel discharge angle of a molten steel discharge hole directing downward from a horizontal direction is set to 10° or more and less than 30° is provided, and the molten steel discharge hole is positioned between a peak position of a magnetic field of the upper magnetic poles and a peak position of a magnetic field of the lower magnetic poles, while a molten steel flow is braked by a DC magnetic field applied to the pair of upper magnetic poles and the pair of lower magnetic poles, wherein molten steel containing chemical components where an X value defined by a following formula (1) satisfies $X \leq 5000$ is continuously cast at a casting speed of 0.75 m/min or more and in accordance with following conditions (X), (Y).

$$X=24989\times[\%\ Ti]+386147\times[\%\ S]+853354\times[\%\ O] \quad (1)$$

Here, [% Ti]: Ti content in molten steel (mass %), [% S]: S content in molten steel (mass %), and [% O]: O content in molten steel (mass %).

Condition (X): When a slab width of a slab to be cast and a casting speed fall within following ranges (a) to (i), intensity of a DC magnetic field applied to the upper magnetic poles is set to 0.03 to 0.15 T and intensity of a DC magnetic field applied to the lower magnetic poles is set to 0.24 to 0.45 T.

(a) the slab width being less than 950 mm and the casting speed being less than 2.05 m/min, (b) the slab width being 950 mm or more and less than 1050 mm and the casting speed being less than 2.25 m/min, (c) the slab width being 1050 mm or more and less than 1350 mm and the casting speed being less than 2.35 m/min, (d) the slab width being 1350 mm or more and less than 1450 mm and the casting speed being less than 2.25 m/min, (e) the slab width being 1450 mm or more and less than 1650 mm and the casting speed being less than 2.15 m/min, (f) the slab width being 1650 mm or more and less than 1750 mm and the casting speed being less than 2.05 m/min, (g) the slab width being 1750 mm or more and less than 1850 mm and the casting speed being less than 1.95 m/min, (h) the slab width being 1850 mm or more and less than 1950 mm and the casting speed being less than 1.85 m/min, and (i) the slab width being 1950 mm or more and less than 2150 mm and the casting speed being less than 1.75 m/min.

Condition (Y): when a slab width of a slab to be cast and a casting speed fall within following ranges (j) to (s), intensity of a DC magnetic field applied to the upper magnetic poles is set to more than 0.15 to 0.30 T and intensity of a DC magnetic field applied to the lower magnetic poles is set to 0.24 to 0.45 T.

(j) the slab width being less than 950 mm and the casting speed being 2.05 m/min or more and 3.05 m/min or less, (k) the slab width being 950 mm or more and less than 1050 mm and the casting speed being 2.25 m/min or more and 3.05 m/min or less, (l) the slab width being 1050 mm or more and less than 1350 mm and the casting speed being 2.35 m/min or more and 3.05 m/min or less, (m) the slab width being 1350 mm or more and less than 1450 mm and the casting speed being 2.25 m/min or more and 3.05 m/min or less, (n) the slab width being 1450 mm or more and less than 1550 mm and the casting speed being 2.15 m/min or more and 3.05 m/min or less, (o) the slab width being 1550 mm or more and less than 1650 mm and the casting speed being 2.15 m/min or more and 2.85 m/min or less, (p) the slab width being 1650 mm or more and less than 1750 mm and the casting speed being 2.05 m/min or more and 2.65 m/min or less, (q) the slab width being 1750 mm or more and less than 1850 mm and the casting speed being 1.95 m/min or more and 2.55 m/min or less, (r) the slab width being 1850 mm or more and less than 1950 mm and the casting speed being 1.85 m/min or more and 2.55 m/min or less, and (s) the slab width being 1950 mm or more and less than 2150 mm and the casting speed being 1.75 m/min or more and 2.55 m/min or less.

[2] A method for manufacturing a steel sheet where a hot-rolled steel sheet is obtained by hot rolling a slab produced by casting using the continuous casting method in the above-mentioned [1], the hot-rolled steel sheet is subject to pickling and, thereafter, in applying cold rolling to the hot-rolled steel sheet, time t and/or a maximum surface temperature T of the steel sheet is controlled so as to satisfy a following formula (1a).

$$Hc/Ho > \exp\{-0.002\times(T+t/100)\} \quad (1a)$$

Here, Ho: hydrogen concentration (mass ppm) in steel sheet immediately after pickling is finished Hc: critical hydrogen concentration (mass ppm) in steel sheet immediately before cold rolling at which surface quality defects occur by blister, the critical hydrogen concentration being determined based on cold rolling conditions t: time until cold rolling starts after pickling is finished (seconds)

T: maximum surface temperature T (K) of steel sheet after pickling is finished and before cold rolling starts (the steel sheet surface temperature also includes steel sheet surface temperature when the steel sheet is heated after pickling is finished and before cold rolling)

[3] In the continuous casting method for steel or the method for manufacturing a steel sheet in the above-mentioned [1] or [2], a nozzle immersing depth of the immersion nozzle is set to a value which falls within a range from 230 to 290 mm.

[4] In the continuous casting method for steel or the method for manufacturing a steel sheet in any one of the above-mentioned [1] to [3], a nozzle inner diameter (the nozzle inner diameter at a position where the molten steel discharge hole is formed) of the immersion nozzle is set to a value which falls within a range from 70 to 90 mm.

[5] In the continuous casting method for steel or the method for manufacturing a steel sheet in any one of the above-mentioned [1] to [4], an opening area of each molten steel discharge hole of the immersion nozzle is set to a value which falls within a range from 3600 to 8100 $mm^2$.

[6] In the continuous casting method for steel or the method for manufacturing a steel sheet in any one of the above-mentioned [1] to [5], with respect to the molten steel in the mold, turbulence energy of molten steel on top surface is set to a value which falls within a range from 0.0010 to 0.0015 $m^2/s^2$, flow velocity of molten steel on top surface is set to 0.30 m/s or less, and flow velocity of molten steel at molten steel-solidified shell interface is set to a value which falls within a range from 0.08 to 0.15 m/s.

[7] In the continuous casting method for steel or the method for manufacturing a steel sheet in the above-mentioned [6], with respect to the molten steel in the mold, the flow velocity of molten steel on top surface is set to a value which falls within a range from 0.05 to 0.30 m/s.

[8] In the continuous casting method for steel or the method for manufacturing a steel sheet in the above-mentioned [6] or [7], with respect to the molten steel in the mold, a ratio A/B between flow velocity of molten steel at molten steel-solidified shell interface A and flow velocity of molten steel on top surface B is set to a value which falls within a range from 1.0 to 2.0.

[9] In the continuous casting method for steel or the method for manufacturing a steel sheet in any one of the above-mentioned [6] to [8], with respect to the molten steel in the mold, concentration of bubbles at molten steel-solidified shell interface is set to 0.008 $kg/m^3$ or less.

[10] In the continuous casting method for steel or the method for manufacturing a steel sheet in the above-mentioned [9], a slab thickness of a slab to be cast is set to a value which falls within a range from 220 to 300 mm, and a blow-off amount of an inert gas from an inner wall surface of the immersion nozzle is set to a value which falls within a range from 3 to 25 NL/min.

[11] In the method for manufacturing a steel sheet in any one of the above-mentioned [2] to [10], a hot-rolled steel sheet after pickling and before cold rolling is heated to a temperature higher than a steel sheet temperature immediately after the pickling is finished.

According to the continuous casting method for steel according to embodiments of the present invention, by adjusting the chemical components of extremely low carbon steel within the specified range by taking into account the interface tension gradient in the concentration boundary layer on the front surface of the solidified shell, and also by optimizing intensities of the DC magnetic fields applied to the upper magnetic poles and the lower magnetic poles respectively corresponding to the slab width of the slab to be casted and a casting speed, it is possible to acquire the slab having high quality not only with the small number of defects caused by non-metallic inclusions and a mold flux which have been considered as problems conventionally but also with the small number of defects caused by minute bubbles and minute non-metallic inclusions.

Further, particularly, by optimizing the nozzle immersing depth and the nozzle inner diameter of the immersion nozzle and an opening area of a molten steel discharge hole, it is possible to produce a slab having higher quality.

Still further, according to the method for manufacturing a steel sheet, a steel sheet having high quality with extremely small number of blisters can be manufactured.

DETAILED DESCRIPTION OF EMBODIMENTS OF THE INVENTION

Figure 1:
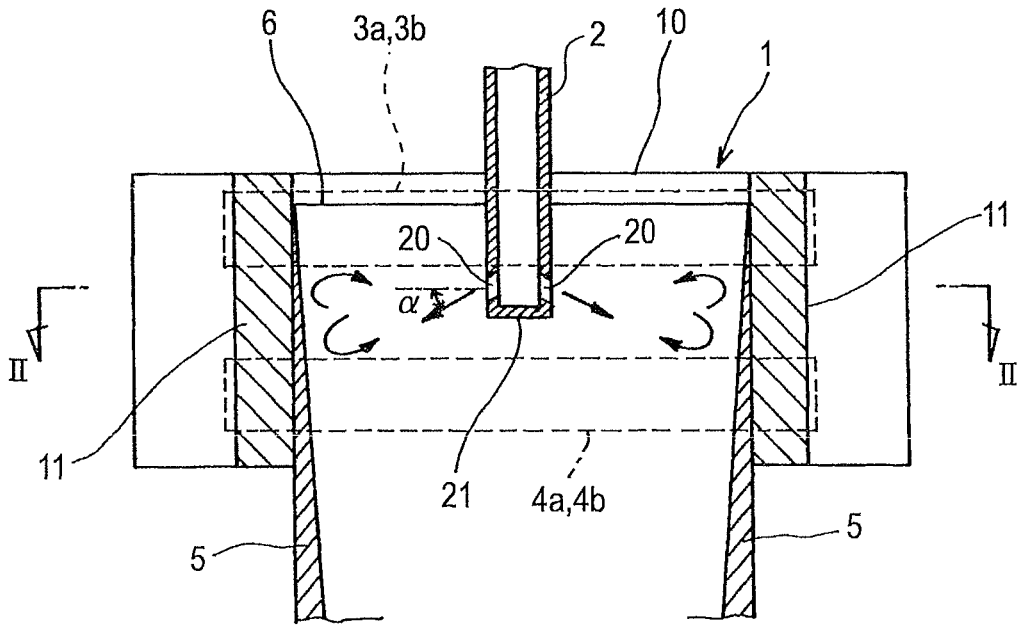
FIG. 1 is a longitudinal cross-sectional view of a mold of a continuous casting machine and an immersion nozzle of an embodiment for carrying out the present invention.

In a continuous casting method for steel according to embodiments of the present invention, extremely low carbon steel is continuously cast using a continuous casting machine where a pair of upper magnetic poles which is arranged to face each other with a mold long-side portion sandwiched therebetween and a pair of lower magnetic poles which is arranged to face each other with the mold long-side portion sandwiched therebetween are provided to an outer side of the mold (a back surface of a side wall of the mold), an immersion nozzle with a molten steel discharge angle $\alpha$ of a molten steel discharge hole directing downward from a horizontal direction is set to 10° or more and less than 30° is provided, and the molten steel discharge hole is positioned between a peak position of a magnetic field of the upper magnetic poles and a peak position of a magnetic field of the lower magnetic poles. The extremely low carbon steel continuously casts a molten steel flow while braking the molten steel flow with a DC magnetic field applied to the pair of upper magnetic poles and the pair of lower magnetic poles.

The inventors of the present invention have studied the above-mentioned continuous casting method by performing numerical value simulations and the like and, as a result of the study, have found that, as factors relating to the occurrence of bubble-caused defects, inclusion-caused defects and mold-flux-caused defects (primary factors), turbulence energy of molten steel on top surface (relating to the occurrence of a vortex flow in the vicinity of the top surface), flow velocity of molten steel at molten steel-solidified shell interface (hereinafter may be also simply referred to as "solidification interface") (hereinafter also may be simply referred to as "flow velocity of molten steel at solidification interface") and flow velocity of molten steel on top surface are listed, and these factors influence the occurrence of defects. Particularly, the inventors have found that the flow velocity of molten steel on top surface and the turbulence energy of molten steel on top surface influence the entrainment of a mold flux, and the flow velocity of molten steel at solidification interface influences bubble-caused defects and inclusion-caused defects. The inventors of the present invention have studied various actions generated by an upper DC magnetic field and a lower DC magnetic field applied to a molten steel flow based on such findings, and the followings are clarified as a result of the study.

(1) When a DC magnetic field is applied to the upper magnetic poles, an upward flow of molten steel (an upward flow which is generated when a blow-off flow from the molten steel discharge hole impinges on a mold short side and is reversed) is braked so that flow velocity of molten steel on top surface and turbulence energy of molten steel on top surface can be reduced. With only such a DC magnetic field, however, the flow velocity of molten steel on top surface, the turbulence energy of molten steel on top surface and flow velocity of molten steel at solidification interface cannot be controlled in an ideal state.

(2) From the above-mentioned point, it is considered that the application of a DC magnetic field to the upper magnetic poles is effective for preventing both bubble-caused defects/inclusion-caused defects and mold-flux-caused defects. However, when only the DC magnetic field is applied to the upper magnetic poles, a sufficient advantageous effect in braking cannot be obtained, and casting conditions (a slab width of a slab to be cast, casting speed) and an application condition of a DC magnetic field applied to the upper magnetic poles and the lower magnetic poles respectively are mutually relevant to each other and optimum ranges exist with respect to these conditions.

(3) Particularly, to prevent minute non-metallic inclusions or the like from being caught in a solidified shell, it is necessary to adjust the chemical component of molten steel to a composition range where non-metallic inclusions or the like are hardly caught in the solidified shell at molten steel-solidified shell interface (that is, a range specified by taking into account an interface tension gradient in a concentration boundary layer on a front surface of the solidified shell), and based on such adjustment, it is necessary to set flow velocity of molten steel at solidification interface to an appropriate value by optimizing the intensity of the above-mentioned DC magnetic field thus acquiring a cleaning effect by a molten steel flow.

In the present invention, the continuous casting of extremely low carbon steel is preferably performed under the following conditions (A), (B) based on such finding, and such continuous casting can effectively suppress both the occurrence of bubble-caused defects/inclusion-caused defects and the occurrence of mold-flux-caused defects.

Condition (A): Chemical components of molten steel (extremely low carbon steel) are adjusted within a specified range determined by taking into account an interface tension gradient in a concentration boundary layer of a front surface of a solidified shell.

Condition (B): Intensities of DC magnetic fields applied to the upper magnetic poles and the lower magnetic poles respectively are optimized corresponding to a slab width of a slab to be casted and a casting speed.

Figure 2:
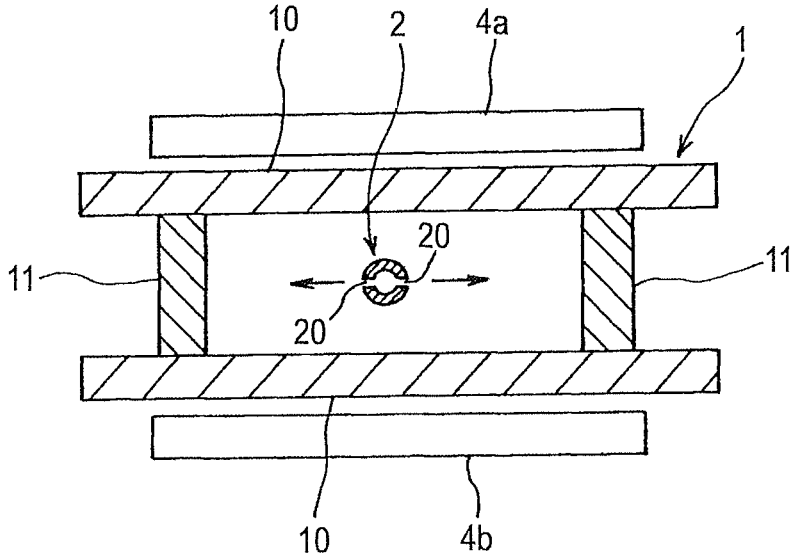
FIG. 2 is a horizontal cross-sectional view of the mold and the immersion nozzle of the embodiment shown in FIG. 1.

FIG. 1 and FIG. 2 show a mold of a continuous casting machine and an immersion nozzle of one embodiment for carrying out the present invention, wherein FIG. 1 is a longitudinal cross-sectional view of the mold and the immersion nozzle, and FIG. 2 is a horizontal cross-sectional view of the mold and the immersion nozzle (cross-sectional view taken along a line II-II in FIG. 1).

In the drawing, numeral 1 indicates the mold, wherein the mold 1 is formed of mold long side portions 10 (mold side walls) and mold short side portions 11 (mold side walls) and has a rectangular shape as viewed in a horizontal cross section.

Numeral 2 indicates the immersion nozzle, and molten steel in a tundish (not shown in the drawing) arranged above the mold 1 is poured into the mold 1 through the immersion nozzle 2. The immersion nozzle 2 has a bottom portion 21 at a lower end of a cylindrical nozzle body, and a pair of molten steel discharge holes 20 is formed in a side wall portion at a position right above the bottom portion 21 such that the molten steel discharge holes 20 face both mold short side portions 11 in an opposed manner respectively.

To prevent a case where non-metallic inclusions such as alumina in molten steel adhere to or are stacked on an inner wall surface of the immersion nozzle 2 thus clogging the nozzle, an inert gas such as an Ar gas is introduced into a gas passage formed in the inside of the nozzle body of the immersion nozzle 2 or in the inside of an upper nozzle (not shown in the drawing), and such an inert gas is blown into the nozzle through an inner wall surface.

The molten steel which is flown into the immersion nozzle 2 from the tundish is discharged into the mold 1 through the pair of molten steel discharge holes 20 formed in the immersion nozzle 2. The discharged molten steel forms a solidified shell 5 by being cooled in the mold 1, and the solidified shell 5 is continuously drawn to an area below the mold 1 so that a slab is formed. A mold flux is added to a meniscus 6 in the mold 1 as a heat insulation agent for molten steel and as a lubricant between the solidified shell 5 and the mold 1.

Further, bubbles of the inert gas blown through the inner wall surface of the immersion nozzle 2 and through the inner portion of the upper nozzle are discharged into the inside of the mold 1 together with the molten steel from the molten steel discharge holes 20.

On an outer side of the mold 1 (a back surface of the mold side wall), a pair of upper magnetic poles 3*a*, 3*b* which is arranged so that the upper magnetic poles 3*a*, 3*b* face each other with the long side portion of the mold sandwiched therebetween and a pair of lower magnetic poles 4*a*, 4*b* which is arranged so that the lower magnetic poles 4*a*, 4*b* face each other with the long side portion of the mold sandwiched therebetween are mounted. The upper magnetic poles 3*a*, 3*b* and the lower magnetic poles 4*a*, 4*b* are arranged so as to extend over the whole width of the mold long side portion 10 in the widthwise direction.

The upper magnetic poles 3*a*, 3*b* and the lower magnetic poles 4*a*, 4*b* are arranged such that, in the vertical direction of the mold 1, the molten steel discharge holes 20 are positioned between a peak position of a magnetic field of the upper magnetic poles 3*a*, 3*b* (peak position in the vertical direction: usually, a center position of the upper magnetic poles 3*a*, 3*b* in the vertical direction) and a peak position of a magnetic field of the lower magnetic poles 4*a*, 4*b* (peak position in the vertical direction: usually, a center position of the lower magnetic poles 4*a*, 4*b* in the vertical direction). Further, the pair of upper magnetic poles 3*a*, 3*b* is usually arranged at a position where the upper magnetic poles 3*a*, 3*b* cover the meniscus 6.

The molten steel discharged from the molten steel discharge holes 20 of the immersion nozzle 2 in the directions toward the mold short side portions 11 impinges on the solidified shell 5 formed on front surfaces of the mold short side portions 11 so that the molten steel is divided into an upward molten steel flow and a downward molten steel flow. A DC magnetic field is applied to the pair of upper magnetic poles 3*a*, 3*b* and the pair of lower magnetic poles 4*a*, 4*b* respectively. A basic action brought about these magnetic poles is that by making use of an electromagnetic force which acts on the molten steel moving in the DC magnetic field, the upward molten steel flow is braked (subject to the reduction of speed) by the DC magnetic field applied to the upper magnetic poles 3*a*, 3*b*, and the downward molten steel flow is braked (subject to reduction of speed) by the DC magnetic field applied to the lower magnetic poles 4*a*, 4*b*.

In an embodiment of the method of the present invention, used is an immersion nozzle where a molten steel discharge angle $\alpha$ at which the molten steel is discharged from the molten steel discharge hole 20, that is, the molten steel discharge angle α directing downward from a horizontal direction is set to 10° or more and less than 30°. In case the molten steel discharge angle α is set to less than 10°, even when the upward molten steel flow is braked by the DC magnetic field of the upper magnetic poles 3*a*, 3*b*, the disturbance of a surface of the molten steel cannot be properly controlled and hence, the entrainment of the mold flux occurs. To the contrary, it is found that when the molten steel discharge angle α is set large, the non-metallic inclusion and bubbles are carried to a lower side of the mold by the downward molten steel flow so that the non-metallic inclusions and bubbles are liable to be caught in the solidified shell, while when the molten steel discharge angle α is set to less than 30°, the molten steel flow can be optimized using a DC magnetic field control according to an exemplary method of the present invention. Accordingly, the immersion nozzle 2 with the molten steel discharge angle α of less than 30° is preferably used in the present invention. Further, from the above-mentioned viewpoint, a lower limit of the molten steel discharge angle α is more preferably set to 15°, and an upper limit of the molten steel discharge angle α is more preferably set to 25°.

Figure 3:
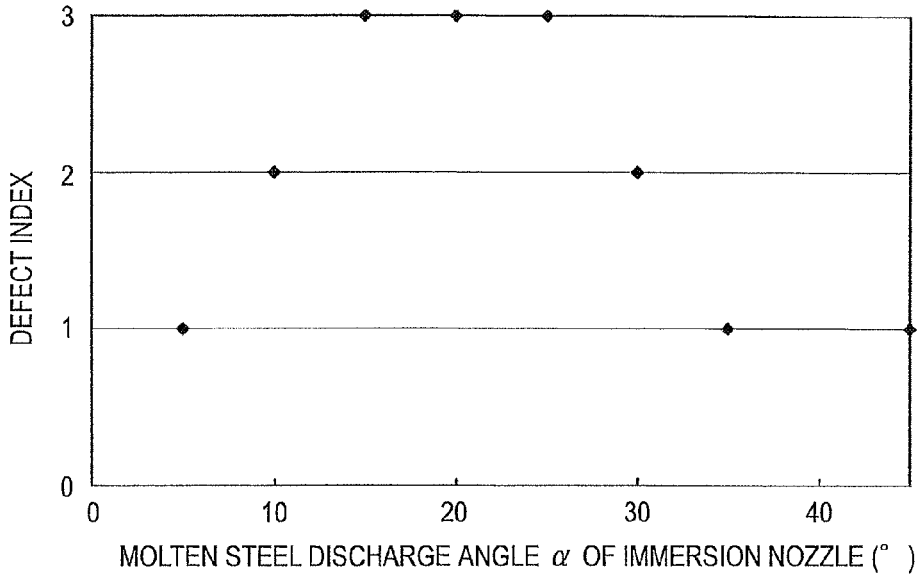
FIG. 3 is a graph showing the relationship between a molten steel discharge angle of the immersion nozzle and an occurrence rate of surface defects (defect index).

FIG. 3 shows the relationship between the molten steel discharge angle α of the immersion nozzle and an occurrence rate of surface defects (defect index). A continuous casting test is performed under various conditions where the molten steel composition and intensity of a magnetic field, a casting speed and a slab width under conditions (X), (Y) described later satisfy ranges defined by the present invention. In the test, the slab which is produced by continuous casting is formed into a steel sheet by hot rolling and cold rolling, hot-dip galvannealing treatment is applied to the steel sheet, and the influence of the molten steel discharge angle α exerted on the occurrence of such surface defects is examined. In this test, surface defects of a hot-dipped galvannealed steel sheet are continuously measured using an online surface defect meter. Out of the surface defects, steel-making-caused defects (mold-flux-caused defects, and bubble-caused defects/inclusion-caused defects) are determined by the defective appearance, an SEM analysis, an ICP analysis or the like, and the number of defects per 100 m of a coil length is evaluated on the basis of the following criteria and is set as a surface defect index.

3: the number of defects being 0.30 or less

2: the number of defects being 0.30 or more and 1.00 or less

1: the number of defects being 1.00 or more

Hereinafter, the conditions (A), (B) described above are explained in order.

Condition (A)

In an embodiment of the present invention, molten steel containing chemical component where C: 0.003 mass % or less, and an X value defined by the following formula (1) satisfies X≤5000 is set as an object of casting.

$$X=24989\times[\%\ \mathrm{Ti}]+386147\times[\%\ \mathrm{S}]+853354\times[\%\ \mathrm{O}] \quad (1)$$

Here, [% Ti]: Ti content in molten steel (mass %),

[% S]: S content in molten steel (mass %), and

[% O]: O content in molten steel (mass %).

Extremely low carbon steel whose C content is 0.003 mass or less is produced by melting through decarburization refining at an atmospheric pressure in a steel converter and decarburization refining under a reduced pressure in vacuum degassing facility such as an RH vacuum degassing device (hereinafter, referred to as "vacuum decarburization refining"). The decarburization refining does not advance unless the concentration of resolved oxygen in molten steel reaches a certain level and hence, a large amount of resolved oxygen remains in molten steel at the time of finishing decarburization refining. The cleanliness of steel is degraded when a large amount of resolved oxygen remains in this manner and hence, in a melting step of extremely low carbon steel, after vacuum decarburization refining is finished, metal Al is added to molten steel thus performing deoxidization treatment of molten steel. Due to this deoxidization treatment, the concentration of dissolved oxygen in molten steel is rapidly lowered and alumina is formed as a deoxidized product.

Alumina formed in this manner is coagulated during a period before molten steel is poured into the inside of a mold for casting thus forming alumina cluster. Most of non-metallic inclusions (hereinafter, simply referred to as "inclusions") contained in molten steel is formed of alumina cluster. When such inclusions are poured into the inside of the mold together with molten steel and are caught in a solidified shell of a slab, the inclusions become a surface defect of an extreme low carbon steel slab thus lowering quality of the slab.

The inventors of the present invention have studied in detail the influence of chemical components of molten steel and flow velocity of molten steel on a front surface of a solidified shell exerted on the catching of inclusions in the solidified shell, and as a result of the study, the inventors have found that the catching of the inclusions or the like in the solidified shell can be effectively suppressed by setting the chemical components of the molten steel (extremely low carbon steel whose C content is 0.003 mass % or less) to satisfy X value≤5000 and by controlling a flow state of molten steel by the condition (B) described later thus adjusting flow velocity of molten steel at solidification interface to an appropriate value.

The above-mentioned X value indicates a scale of an attracting force in the direction toward the solidified shell due to an interfacial tension gradient which acts on inclusions intruded into a concentration boundary layer of solute elements (Ti, S, O) formed on a front surface of the solidified shell in the mold.

Hereinafter, reasons that the X value is induced are explained.

As described in publication "Iron and Steel Vol. 80 (1994)" p. 527, a force F which the inclusions receive in the direction toward the solidified shell due to an interfacial tension gradient K, that is, dσ/dx (σ: interfacial tension, x: distance), in the concentration boundary layer formed on the front surface of the solidified shell is expressed by the following formula (2)

$$F=-(8/3)\times\pi R^2K \quad (2)$$

Here, F: force which inclusion receives (N)

π: circle ratio

R: radius of inclusion (m)

K: interfacial tension gradient ($N/m^2$)

The interfacial tension gradient K is, as expressed by the following formula (3), the product of a change in interfacial tension due to solute element concentration and a concentration gradient of a component.

$$K=d\sigma/dx=(d\sigma/dc)\times(dc/dx) \quad (3)$$

Here, σ: interfacial tension between molten steel and inclusion (N/m)

x: distance from solidification interface (m)

dσ/dc: change in interfacial tension due to solute element concentration (N/m/mass %)

dc/dx: concentration gradient of component (mass %/m)

Based on the theory on solidification, the concentration gradient dc/dx of the component under a condition where flow velocity of molten steel is present as in the case of the inside of the mold is expressed by the following formula (4).

$$dc/dx=-C_o\times(1-Ko)\times(V_s/D)\times\exp[-V_s\times(x-\delta)/D] \quad (4)$$

Here, $C_o$: solute element concentration in molten steel before casting (mass %)

$K_o$: distribution coefficient of solute element (–)

$V_s$: solidification speed (m/s)

D: diffusion coefficient of solute element in molten steel ($m^2/s$)

δ: thickness of concentration boundary layer (m)

In the above-mentioned formula (4), by assigning δ to x, the concentration gradient (dc/dx) when x is δ (x=δ) can be obtained by the following formula (5).

$$dc/dx=-C_o\times(1-K_o)\times(V_s/D) \quad (5)$$

By substituting the formula (5) for the formula (3), the interfacial tension gradient K indicating the scale of a force which acts immediately after the inclusions intrude into the concentration boundary layer can be obtained by the following formula (6).

$$K=(d\sigma/dc)\times[-C_o\times(1-K_o)\times(V_s/D)] \quad (6)$$

Here, dσ/dc in the above-mentioned formula (6) is described in publication "Manual on physical property of molten iron and molten slag" (edited by The Iron and Steel Institute of Japan, 1972), and it is found that, out of chemical constitutional elements in extremely low carbon steel, the elements which largely influence a value of interfacial tension gradient K are Ti (titanium), S (sulfur) and O (oxygen=dissolved oxygen), and there arises no problem even when the value of interfacial tension gradient K which is calculated based on these active elements are used in examining the catching of the inclusions in the solidified shell.

Further, although the distribution coefficients $K_o$ of the solute elements are described in publication "Basis of Manual on Iron and Steel, third version" (edited by The Iron and Steel Institute of Japan, 1981, p. 194 and the like, for example, with respect to the distribution coefficients $K_O$ of the respective solute elements, values of the distribution coefficients $K_O$ of the respective solute elements described in "Iron and Steel, Vol. 80 (1994)" p. 534 are used.

Although the diffusion coefficient D is described in publication "Manual on physical property of molten iron and molten slag" (edited by The Iron and Steel Institute of Japan, 1992) and the like, for example, with respect to O and S, values described in "Iron and Steel Vol. 80 (1994)" p. 534 are used, and with respect to Ti, a value described in "Iron and Steel Vol. 83 (1997)" p. 566 is used.

Further, the solidification speed $V_S$ can also be obtained by the heat-transfer calculation. $V_S$ is calculated using 0.0002 m/s.

Values shown in Table 1 are used as values of dσ/dc, $K_o$, D, $V_S$ of Ti (titanium), S (sulfur) and O (oxygen=dissolved oxygen).

TABLE 1

| | $K_o$ (—) | $V_s$ (m/s) | D ($m^2/s$) | ds/dc (N/m/mass %) |
|---|---|---|---|---|
| [Ti] | 0.40 | 0.0002 | 5.70E−09 | −1.187 |
| [S] | 0.05 | 0.0002 | 3.40E−09 | −6.910 |
| [O] | 0.02 | 0.0002 | 2.60E−09 | −11.320 |

Accordingly, by substituting a change dσ/dc in an interfacial tension of each solute element based on the concentration of the solute element, a distribution coefficient $K_O$, a diffusion coefficient D, and a solidification speed $V_s$ in the mold of the above-mentioned respective solute elements for the above-mentioned formula (6), 24989×[% Ti], 386147×[% S] and 853354×[% O] can be obtained as respective interfacial tension gradients K due to Ti, S and O which act on alumina clusters in a concentration boundary layer, and the total of these interfacial tension gradients K constitute the X value.

By carrying out a casting test using molten steels having various compositions, the relationship between the above-mentioned X value and a catch rate of inclusions in a solidified shell is examined. In this test, the relationship between the X value and the catch rate of inclusions at respective flow velocities of molten steel at solidification interface is examined with respect to cases where the flow velocity of molten steel at solidification interface in the mold is 0.01 m/s, 0.08 m/s, 0.10 m/s and 0.15 m/s respectively. Here, the catch rate of inclusions is, as shown in the above-mentioned formula (7), a value which is obtained by dividing an inclusion index in the solidified shell by an inclusion index in molten steel, and is a value which indicates the frequency of catching inclusions per unit inclusion concentration.

$$\alpha=I/A \quad (7)$$

Here, α: catch rate of inclusions (–)

I: inclusion index in solidified shell (–)

A: inclusion index in molten steel (–)

Here, the inclusion index is a value which is obtained such that a long axis and a short axis of the inclusion are measured by an optical microscope, an area of the inclusion as an ellipsoidal body is calculated, and a value obtained by summing areas of the observed inclusions is divided by the measured area, and is an index which indicates the number of inclusions included in a unit measured area. The inclusion index of the molten steel can be calculated by measuring inclusions in a specimen sampled from molten steel.

Figure 4:
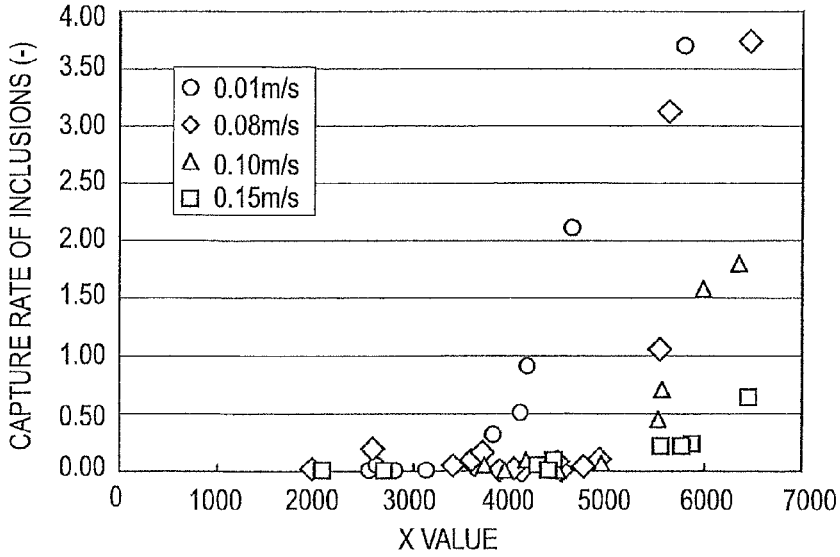
FIG. 4 is a graph showing the relationship between an X value of molten steel, flow velocity of molten steel at a molten-steel solidified shell interface, and a catch rate of non-metallic inclusions by a solidified shell.

The above-mentioned test result is shown in FIG. 4. It is understood that when the X value is 5000 or less (X value≤5000), the catching of the inclusions in the solidified shell can be suppressed by imparting a certain level of flow velocity of molten steel at solidification interface. Further, such an advantageous effect becomes large when the X value is 4000 or less (X value≤4000), particularly, when the X value is 3000 or less (X value≤3000). Accordingly, by setting the chemical components of the molten steel such that the X value becomes 5000 or less (X value≤5000) (preferably to 4000 or less (X value≤4000), more preferably to 3000 or less (X value≤3000)), and by imparting flow velocity of molten steel at solidification interface under conditions (B) described later, it is possible to properly prevent the catching of the inclusions (particularly, fine inclusions) and the like in the solidified shell. Here, due to the limitation imposed on the chemical components in molten steel (extremely low carbon steel), usually, a substantial lower limit of the X value is set to approximately 2000.

With respect to the chemical composition of the molten steel produced by casting according to the present invention, provided that C content is 0.003 mass % or less and the X value is less than 5000 (X value≤5000), contained elements are not particularly limited. However, from a viewpoint of particularly effectively obtaining the advantageous effects of the present invention, as chemical components other than C, the steel preferably contains Si: 0.05 mass % or less, Mn: 1.0 mass % or less, P: 0.05 mass % or less, S: 0.015 mass % or less, Al: 0.010 to 0.075 mass %, Ti: 0.005 to 0.05 mass %, and also contains one or more kinds of components selected from a group consisting of Nb: 0.005 to 0.05 mass % when necessary, and contains Fe and unavoidable impurities as a balance.

Hereinafter, the reason of limiting the above-described chemical components is explained.

C deteriorates workability of a thin steel sheet when C content becomes high. Accordingly, C content is set to 0.003 mass % or less so that a steel having excellent elongation and deep drawing property as an IF steel (Interstitial-Free steel) can be acquired when a carbide forming element such as Ti or Nb is added to the steel.

Si is a solid solution strengthening element, when Si content is large, workability of the thin steel sheet is deteriorated. Further, an upper limit of Si content is preferably set to 0.05 mass % also by taking the influence of Si exerted on the surface treatment into consideration.

Mn is a solid solution strengthening element. Although the addition of Mn increases the strength of the steel, the addition of Mn lowers workability of steel on the other hand. Accordingly, an upper limit of Mn content is preferably set to 1.0 mass %.

P is a solid solution strengthening element, and the addition of P increases the strength of steel. However, when P content exceeds 0.05 mass %, workability and weldability are deteriorated and hence, an upper limit of P content is preferably set to 0.05 mass %.

S cause cracks at the time of hot rolling, and forms an A-based inclusion which lowers workability of a thin steel sheet. Accordingly, S content is preferably decreased as much as possible. Accordingly, an upper limit of the content of S is preferably set to 0.015 mass %.

Al functions as a deoxidizing agent, and Al content is preferably set to 0.010 mass % or more for acquiring a deoxidizing effect. However, the addition of Al exceeding a necessary amount pushes up the manufacturing cost and hence, Al content is preferably set to a value which falls within a range from 0.010 to 0.075 mass %.

Ti fixes C, N, S in the steel as precipitates, and the addition of Ti enhances workability and deep drawing property of steel. However, when Ti content is less than 0.005 mass %, the sufficient workability and deep drawing property enhancing effect cannot be acquired. On the other hand, Ti is also a precipitation strengthening element and hence, when the content of Ti exceeds 0.05 mass %, a steel sheet is hardened and workability is deteriorated. Accordingly, Ti content is preferably set to a value which falls within a range from 0.005 to 0.05 mass %.

Nb fixes C, N, S in the steel as precipitates in the same manner as Ti, and the addition of Nb enhances workability and deep drawing property of the steel. However, when Nb content is less than 0.005 mass %, the sufficient workability and deep drawing property enhancing effect cannot be acquired. On the other hand, Nb is also a precipitation strengthening element and hence, when Nb content exceeds 0.05 mass %, the steel sheet is hardened so that the deterioration of workability occurs. Accordingly, Nb content is preferably set to a value which falls within a range from 0.005 to 0.05 mass %.

Condition (B)

It is found that, in casting molten steel containing the above-described chemical components (X value≤5000), it is sufficient to optimize intensities of DC magnetic fields applied to the upper magnetic poles and the lower magnetic poles corresponding to a slab width of a slab to be casted and a casting speed as follows (I), (II) basically.

(I) A "slab width-casting speed" region where a casting speed which is set corresponding to each slab width is relatively small: A throughput amount is relatively small and hence, a blow-off speed of molten steel from the molten steel discharge hole of the immersion nozzle is relatively small. Accordingly, the upward flow (reversed flow) also becomes small and hence, intensity of a DC magnetic field of the upper magnetic poles for braking the upward flow is set relatively small. On the other hand, to suppress inclusions and bubbles which follow the downward flow from getting in the downward molten steel, and also to prevent inclusions and bubbles from being caught in the solidified shell by changing the downward flow of molten steel upwardly and increasing flow velocity of molten steel at an solidification interface in a region above the lower magnetic field, the intensity of a DC magnetic field of the lower magnetic poles is set sufficiently large. By applying the above-mentioned DC magnetic fields to the molten steel under the condition where chemical components of the molten steel satisfies the condition that X value≤5000, it is possible to control turbulence energy of molten steel on top surface, flow velocity of molten steel at solidification interface, and flow velocity of molten steel on top surface to appropriate ranges and hence, it is possible to prevent the occurrence of bubble-caused defects, the inclusion-caused defects, and mold-flux-caused defects.

(II) A "slab width-casting speed" region where a casting speed which is set corresponding to each slab width is relatively large: A throughput amount is relatively large and hence, a blow-off speed of molten steel from the molten steel discharge hole of the immersion nozzle is also relatively large. Accordingly, the upward flow (reversed flow) also becomes large and hence, the intensity of a DC magnetic field of upper magnetic poles for braking the upward flow is set relatively large. On the other hand, in the same manner as the above-mentioned (I), to suppress non-metallic inclusions and bubbles which follow the downward flow from getting in the downward molten steel, and also to prevent non-metallic inclusions and bubbles from being caught in the solidified shell by changing the downward flow of molten steel upwardly and increasing the flow velocity of molten steel at solidification interface in a region above the lower magnetic field, the intensity of a DC magnetic field of the lower magnetic poles is set sufficiently large. By applying the above-mentioned DC magnetic fields to the molten steel under the condition where chemical components of the molten steel satisfy a condition that X value≤5000, it is possible to control turbulence energy of molten steel on top surface, flow velocity of molten steel at solidification interface, and flow velocity of molten steel on top surface to appropriate ranges and hence, it is possible to prevent the occurrence of bubble-caused defects and mold-flux-caused defects.

According to an exemplary method of the present invention, in addition to setting a casting speed to 0.75 m/min or more from a viewpoint of productivity, by optimizing the intensities of DC magnetic fields which are applied to the upper magnetic poles 3*a*, 3*b* and the lower magnetic poles 4*a*, 4*b* respectively corresponding to a slab width of a slab to be casted and a casting speed under the following conditions (X), (Y), it is possible to suppress the entrainment an catching of a mold flux in the solidified shell 5 and, at the same time, the catching of the minute bubbles (mainly, bubbles of an inert gas blown from the inner wall surface of the immersion nozzle) and inclusions in the solidified shell 5 which cause the mold-flux-caused defects, the bubble-caused defects and inclusion-caused defects.

Condition (X): When a slab width of a slab to be cast and a casting speed fall within following ranges (a) to (i), intensity of a DC magnetic field applied to the upper magnetic poles is set to 0.03 to 0.15 T and intensity of a DC magnetic field applied to the lower magnetic poles is set to 0.24 to 0.45 T.

(a) the slab width being less than 950 mm and the casting speed being less than 2.05 m/min, (b) the slab width being 950 mm or more and less than 1050 mm and the casting speed being less than 2.25 m/min, (c) the slab width being 1050 mm or more and less than 1350 mm and the casting speed being less than 2.35 m/min, (d) the slab width being 1350 mm or more and less than 1450 mm and the casting speed being less than 2.25 m/min, (e) the slab width being 1450 mm or more and less than 1650 mm and the casting speed being less than 2.15 m/min, (f) the slab width being 1650 mm or more and less than 1750 mm and the casting speed being less than 2.05 m/min, (g) the slab width being 1750 mm or more and less than 1850 mm and the casting speed being less than 1.95 m/min, (h) the slab width being 1850 mm or more and less than 1950 mm and the casting speed being less than 1.85 m/min, and (i) the slab width being 1950 mm or more and less than 2150 mm and the casting speed being less than 1.75 m/min.

A molten steel flow discharged from the immersion nozzle 2 impinges on the solidified shell on a short-side portion side of the mold so that a reversed flow toward an upper side and a downward flow toward a lower side are generated. When the casting speeds which are set corresponding to the respective slab widths as in the case of the above-mentioned (a) to (i) are relatively small (compared to the condition (Y)), a throughput amount becomes relatively small and hence, a blow-off speed of molten steel from the molten steel discharge hole of the immersion nozzle is relatively small. Accordingly, the upward flow (reversed flow) also becomes small and hence, intensity of a DC magnetic field of upper magnetic poles 3*a*, 3*b* for braking the upward flow is set relatively small. On the other hand, to suppress non-metallic inclusions and bubbles which follow the downward flow from getting in the downward molten steel, and also to prevent non-metallic inclusions and bubbles from being caught in the solidified shell by changing the downward flow of molten steel upwardly and increasing flow velocity of molten steel at an solidification interface in a region above the lower magnetic field, the intensity of a DC magnetic field of the lower magnetic poles 4*a*, 4*b* is set sufficiently large. Particularly, by applying the above-mentioned DC magnetic field to the molten steel thus imparting flow velocity of molten steel at solidification interface to the molten steel under the condition where chemical components of the molten steel are set such that X value≤5000, it is possible to properly prevent the catching of inclusions and bubbles in the solidified shell even when the inclusions and the bubbles are minute.

In the cases of the above-mentioned (a) to (i), when the intensity of the DC magnetic field of the upper magnetic poles 3*a*, 3*b* is less than 0.03 T, an effect of braking an upward molten steel flow by the DC magnetic field is insufficient so that a change of a surface of molten steel is large whereby the entrainment of a mold flux is liable to be generated. On the other hand, when the intensity of the DC magnetic field of the upper magnetic poles 3*a*, 3*b* exceeds 0.15 T, a cleaning effect by the upward molten steel flow is lowered whereby non-metallic inclusions and bubbles are liable to be caught in the solidified shell.

When the intensity of the DC magnetic field of the lower magnetic poles 4*a*, 4*b* is less than 0.24 T, an effect of braking the downward molten steel flow by the DC magnetic field is insufficient and hence, non-metallic inclusions and bubbles which follow the downward molten steel flow get in the downward molten steel flow so that the non-metallic inclusions and bubbles are liable to be caught in the solidified shell. On the other hand, when the intensity of the DC magnetic field of the lower magnetic poles 4*a*, 4*b* exceeds 0.45 T, a cleaning effect by the downward molten steel flow is lowered and hence, non-metallic inclusions and bubbles are liable to be caught in the solidified shell.

Condition (Y): When a slab width of a slab to be cast and a casting speed fall within following ranges (j) to (s), intensity of a DC magnetic field applied to the upper magnetic poles is set to more than 0.15 T to 0.30 T or less and intensity of a DC magnetic field applied to the lower magnetic poles is set to 0.24 to 0.45 T.

(j) the slab width being less than 950 mm and the casting speed being 2.05 m/min or more and 3.05 m/min or less, (k) the slab width being 950 mm or more and less than 1050 mm and the casting speed being 2.25 m/min or more and 3.05 m/min or less, (l) the slab width being 1050 mm or more and less than 1350 mm and the casting speed being 2.35 m/min or more and 3.05 m/min or less, (m) the slab width being 1350 mm or more and less than 1450 mm and the casting speed being 2.25 m/min or more and 3.05 m/min or less, (n) the slab width being 1450 mm or more and less than 1550 mm and the casting speed being 2.15 m/min or more and 3.05 m/min or less, (o) the slab width being 1550 mm or more and less than 1650 mm and the casting speed being 2.15 m/min or more and 2.85 m/min or less, (p) the slab width being 1650 mm or more and less than 1750 mm and the casting speed being 2.05 m/min or more and 2.65 m/min or less, (q) the slab width being 1750 mm or more and less than 1850 mm and the casting speed being 1.95 m/min or more and 2.55 m/min or less, (r) the slab width being 1850 mm or more and less than 1950 mm and the casting speed being 1.85 m/min or more and 2.55 m/min or less, and (s) the slab width being 1950 mm or more and less than 2150 mm and the casting speed being 1.75 m/min or more and 2.55 m/min or less.

When the casting speeds which are set corresponding to the respective slab widths as in the case of the above-mentioned (j) to (s) are relatively large (compared to the condition (X)), a throughput amount becomes inevitably relatively large and hence, a blow-off speed of molten steel from the molten steel discharge hole of the immersion nozzle is also relatively large. Accordingly, the upward flow (reversed flow) also becomes large and hence, intensity of the DC magnetic field of the upper magnetic poles 3*a*, 3*b* for braking the upward flow is set relatively large. On the other hand, in the same manner as the condition (X), to suppress non-metallic inclusions and bubbles which follow the downward flow from getting in the downward molten steel, and also to prevent non-metallic inclusions and bubbles from being caught in the solidified shell by changing the downward flow of molten steel upwardly and increasing flow velocity of molten steel at an solidification interface in a region above the lower magnetic field, the intensity of a DC magnetic field of the lower magnetic poles 4*a*, 4*b* is set sufficiently large. Particularly, by applying the above-mentioned DC magnetic field to the molten steel thus imparting flow velocity of molten steel at solidification interface to the molten steel under the condition where chemical components of the molten steel are set such that X value≤5000, it is possible to properly prevent the catching of inclusions and bubbles in the solidified shell even when the inclusions and the bubbles are minute.

In the cases of the above-mentioned (j) to (s), when the intensity of the DC magnetic field of the upper magnetic poles 3*a*, 3*b* is less than 0.15 T, an effect of braking an upward molten steel flow by the DC magnetic field is insufficient so that a change of a surface of molten steel is large whereby the entrainment of a mold flux is liable to be generated. On the other hand, when the intensity of the DC magnetic field of the upper magnetic poles 3*a*, 3*b* exceeds 0.30 T, a cleaning effect by the upward molten steel flow is lowered whereby non-metallic inclusions and bubbles are liable to be caught in the solidified shell.

When the intensity of the DC magnetic field of the lower magnetic poles 4*a*, 4*b* is less than 0.24 T, an effect of braking the downward molten steel flow by the DC magnetic field is insufficient and hence, non-metallic inclusions and bubbles which follow the downward molten steel flow get in the downward molten steel flow so that the non-metallic inclusions and bubbles are liable to be caught in the solidified shell. On the other hand, when the intensity of the DC magnetic field of the lower magnetic poles 4*a*, 4*b* exceeds 0.45 T, a cleaning effect by the downward molten steel flow is lowered and hence, non-metallic inclusions and bubbles are liable to be caught in the solidified shell.

The continuous casting method of an embodiment of the present invention explained above may be also understood as the following two continuous casting methods (i), (ii) defined corresponding to the slab width and the casting speed.

(i) A continuous casting method for extremely low carbon steel in which extremely low carbon steel containing 0.003 mass % or less of C is continuously cast using a continuous casting machine where a pair of upper magnetic poles which is arranged so that the upper magnetic poles face each other with the long side portion of the mold sandwiched therebetween and a pair of lower magnetic poles which is arranged so that the lower magnetic poles face each other with the mold long-side portion sandwiched therebetween are provided to an outer side of a mold, an immersion nozzle with a molten steel discharge angle of the molten steel discharge hole directing downward from a horizontal direction set to 10° or more and less than 30° is provided, and the molten steel discharge hole is positioned between a peak position of a magnetic field of the upper magnetic poles and a peak position of a magnetic field of the lower magnetic poles, the extremely low carbon steel is continuously cast while braking a molten steel flow by a DC magnetic field applied to the pair of upper magnetic poles and the pair of lower magnetic poles respectively, wherein molten steel containing chemical components where an X value defined by a following formula (1) satisfies X≤5000 is continuously cast at a casting speed of 0.75 m/min or more, under any one of conditions (a) to (i) with respect to a slab width and a casting speed, with intensity of a DC magnetic field applied to the upper magnetic poles set to 0.03 to 0.15 T, and with intensity of a DC magnetic field applied to the lower magnetic poles set to 0.24 to 0.45 T.

$$X=24989\times[\%\ Ti]+386147\times[\%\ S]+853354\times[\%\ O] \quad (1)$$

Here, [% Ti]: Ti content in molten steel (mass %),

[% S]: S content in molten steel (mass %), and

[% O]: O content in molten steel (mass %).

(a) the slab width being less than 950 mm and the casting speed being less than 2.05 m/min, (b) the slab width being 950 mm or more and less than 1050 mm and the casting speed being less than 2.25 m/min, (c) the slab width being 1050 mm or more and less than 1350 mm and the casting speed being less than 2.35 m/min, (d) the slab width being 1350 mm or more and less than 1450 mm and the casting speed being less than 2.25 m/min, (e) the slab width being 1450 mm or more and less than 1650 mm and the casting speed being less than 2.15 m/min, (f) the slab width being 1650 mm or more and less than 1750 mm and the casting speed being less than 2.05 m/min, (g) the slab width being 1750 mm or more and less than 1850 mm and the casting speed being less than 1.95 m/min, (h) the slab width being 1850 mm or more and less than 1950 mm and the casting speed being less than 1.85 m/min, and (i) the slab width being 1950 mm or more and less than 2150 mm and the casting speed being less than 1.75 m/min.

(ii) A continuous casting method for extremely low carbon steel in which extremely low carbon steel containing 0.003 mass % or less of C is continuously cast using a continuous casting machine where a pair of upper magnetic poles which is arranged so that the upper magnetic poles face each other with a mold long-side portion sandwiched therebetween and a pair of lower magnetic poles which is arranged so that the lower magnetic poles face each other with the mold long-side portion sandwiched therebetween are provided to an outer side of a mold, an immersion nozzle with a molten steel discharge angle of a molten steel discharge hole directing downward from a horizontal direction is set to 10° or more and less than 30° is provided, and the molten steel discharge hole is positioned between a peak position of a magnetic field of the upper magnetic poles and a peak position of a magnetic field of the lower magnetic poles, the extremely low carbon steel is continuously cast while braking a molten steel flow by a DC magnetic field applied to the pair of upper magnetic poles and the pair of lower magnetic poles respectively, wherein molten steel containing chemical components where an X value defined by a following formula (1) satisfies X≤5000 is continuously cast at a casting speed of 0.75 m/min or more, under any one of conditions (j) to (s) with respect to a slab width and a casting speed, with intensity of a DC magnetic field applied to the upper magnetic poles set to more than 0.15 T to 0.30 T or less, and with intensity of a DC magnetic field applied to the lower magnetic poles set to 0.24 to 0.45 T.

$$X=24989\times[\%\ Ti]+386147\times[\%\ S]+853354\times[\%\ O] \quad (1)$$

Here, [% Ti]: Ti content in molten steel (mass %),

[% S]: S content in molten steel (mass %), and

[% O]: O content in molten steel (mass %)

(j) the slab width being less than 950 mm and the casting speed being 2.05 m/min or more and 3.05 m/min or less, (k) the slab width being 950 mm or more and less than 1050 mm and the casting speed being 2.25 m/min or more and 3.05 m/min or less, (l) the slab width being 1050 mm or more and less than 1350 mm and the casting speed being 2.35 m/min or more and 3.05 m/min or less, (m) the slab width being 1350 mm or more and less than 1450 mm and the casting speed being 2.25 m/min or more and 3.05 m/min or less, (n) the slab width being 1450 mm or more and less than 1550 mm and the casting speed being 2.15 m/min or more and 3.05 m/min or less, (o) the slab width being 1550 mm or more and less than 1650 mm and the casting speed being 2.15 m/min or more and 2.85 m/min or less, (p) the slab width being 1650 mm or more and less than 1750 mm and the casting speed being 2.05 m/min or more and 2.65 m/min or less, (q) the slab width being 1750 mm or more and less than 1850 mm and the casting speed being 1.95 m/min or more and 2.55 m/min or less, (r) the slab width being 1850 mm or more and less than 1950 mm and the casting speed being 1.85 m/min or more and 2.55 m/min or less, and (s) the slab width being 1950 mm or more and less than 2150 mm and the casting speed being 1.75 m/min or more and 2.55 m/min or less.

Particularly preferable casting conditions under which advantageous effects of the present invention can be most easily realized by the method of the present invention are explained hereinafter.

Firstly, a nozzle immersing depth of the immersion nozzle 2 may preferably be set to a value which falls within a range from 230 to 290 mm. Here, the nozzle immersing depth means a distance from a meniscus 6 to an upper end of the molten steel discharge hole 20.

The reason that the nozzle immersing depth influences the advantageous effects of the present invention is that in either a case where the nozzle immersing depth is excessively large or a case where the nozzle immersing depth is excessively small, when a flow amount or flow velocity of molten steel discharged from the immersion nozzle 2 changes a flow state of the molten steel in the mold largely changes and hence, an appropriate control of the molten steel flow becomes difficult. That is, when the nozzle immersing depth is less than 230 mm, when a flow amount or flow velocity of molten steel discharged from the immersion nozzle 2 changes, a surface of molten steel (meniscus) changes directly and hence, the disturbance of the surface becomes large whereby the entrainment of a mold flux is liable to occur and, on the other hand, when the nozzle immersing depth exceeds 290 mm, when a flow amount of the molten steel or the like changes, there exists a tendency that the downward flow velocity becomes large whereby non-metallic inclusions and bubbles largely get in the molten steel.

Figure 5:
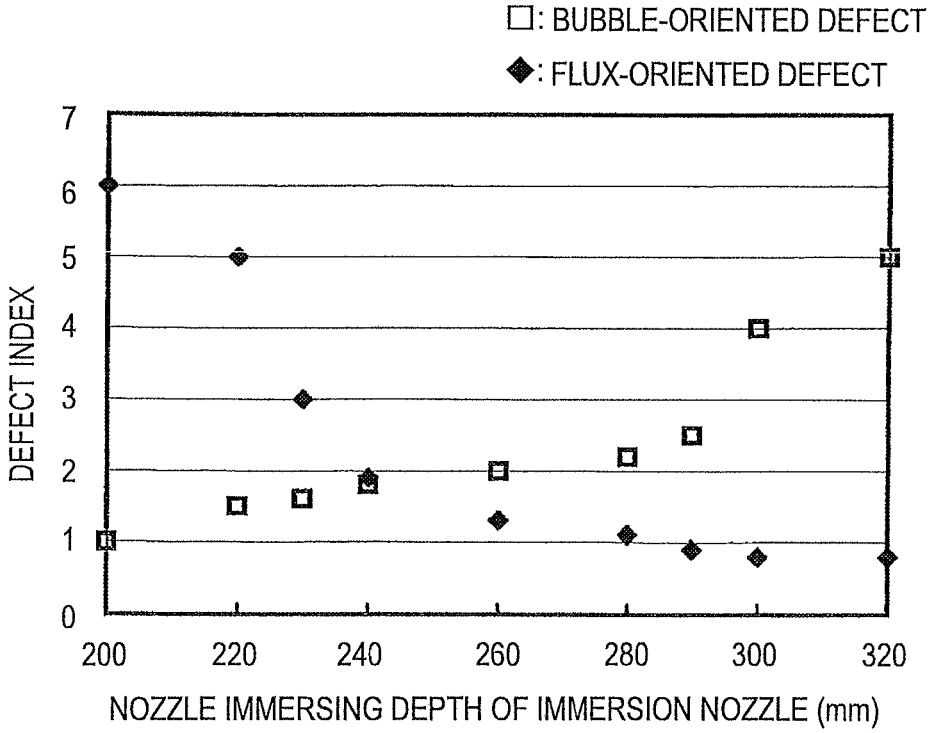
FIG. 5 is a graph showing the influence of a nozzle immersing depth of the immersion nozzle (influence which is exerted on mold-flux-caused defects and bubble-caused defects) in a method of the present invention.

FIG. 5 shows the result examined for the influence of the nozzle immersing depth of the immersion nozzle 2 (influence which is exerted on mold-flux-caused defects and bubble-caused defects) in an exemplary method of the present invention, and shows an inspection result under casting conditions where the molten steel discharge angle $\alpha$ of the molten steel discharge hole of the immersion nozzle is 15°, a slab width is 1200 mm, a slab thickness is 260 mm, casting speed is 1.8 m/min, intensity of a DC magnetic field of the upper magnetic pole is 0.12 T, and intensity of a DC magnetic field of the lower magnetic pole is 0.38 T. Other casting conditions are such that an inner diameter of the immersion nozzle is 80 mm, an opening area of the respective molten steel discharge holes of the immersion nozzle is 4900 $mm^2$ (70 mm×70 mm), a blow-off amount of an inert gas from an inner wall surface of the immersion nozzle is 12 L/min, and viscosity of the used mold flux (1300° C.) is 0.6 cp.

With respect to the cast slabs, using an ultrasonic flaw detector, the respective numbers of bubble-caused defects and mold-flux-caused defects having a particle size of approximately 80 μm or more which are present at a depth position of 2 to 3 mm from a slab surface layer are measured, and the degree of the occurrence of defects is indicated by indexes. It is understood from FIG. 5 that, according to an exemplary method of the present invention, by particularly setting the nozzle immersing depth of the immersion nozzle 2 to a value which falls within a range from 230 to 290 mm, the bubble-caused defects and the mold-flux-caused defects can be reduced more effectively.

Further, a nozzle inner diameter of the immersion nozzle 2, that is, the nozzle inner diameter of the immersion nozzle 2 at a position where the molten steel discharge hole 20 is formed is preferably set to a value which falls within a range from 70 to 90 mm. When alumina or the like partially adheres to the inside of the immersion nozzle 2, a biased flow (symmetric of flow velocity in the widthwise direction being deteriorated) may be generated in molten steel discharged from the immersion nozzle 2, and the biased flow may grow extremely large in such a case when the nozzle inner diameter is less than 70 mm. When such an extremely large biased flow is formed, a molten steel flow in the mold can not be appropriately controlled. On the other hand, although the adjustment of an amount of molten steel which flows into the immersion nozzle 2 is performed by adjusting opening of a sliding nozzle arranged above the immersion nozzle 2, when the nozzle inner diameter exceeds 90 mm, a part where molten steel is not filled may be formed in the inside of the nozzle. Also in this case, an extremely large biased flow substantially equal to the above-mentioned biased flow is formed and hence, a molten steel flow in the mold may not be appropriately controlled.

Figure 6:
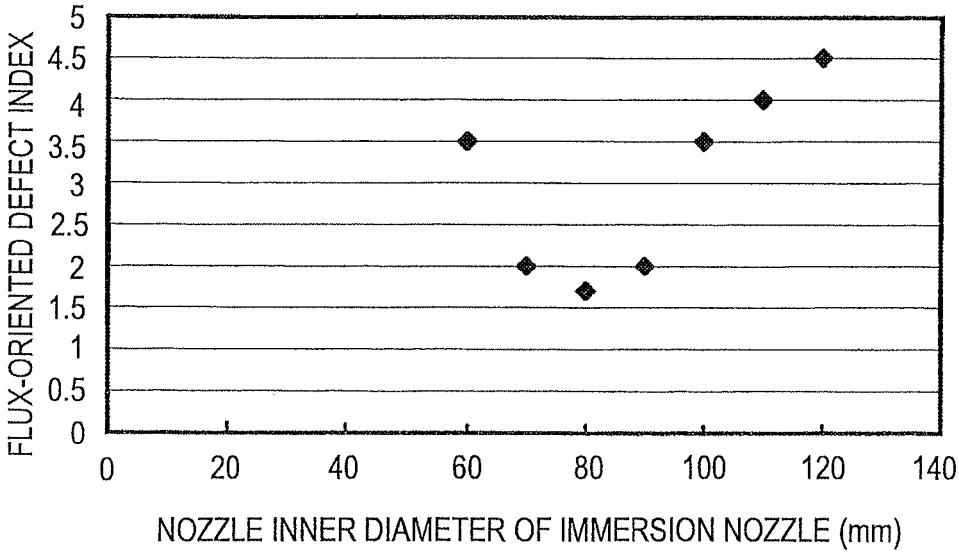
FIG. 6 is a graph showing the influence of a nozzle inner diameter of the immersion nozzle (influence which is exerted on mold-flux-caused defects) in an exemplary method of the present invention.

FIG. 6 shows the result examined for the influence of the nozzle inner diameter of the immersion nozzle 2 (influence which is exerted on mold-flux-caused defects) in an exemplary method of the present invention, and shows an inspection result under casting conditions where the molten steel discharge angle $\alpha$ of the molten steel discharge hole of the immersion nozzle is 15°, a slab width is 1300 mm, a slab thickness is 260 mm, casting speed is 2.5 m/min, intensity of a DC magnetic field of the upper magnetic pole is 0.16 T, and intensity of a DC magnetic field of the lower magnetic pole is 0.38 T. Other casting conditions are such that a nozzle immersing depth of the immersion nozzle is 260 mm, an opening area of the respective molten steel discharge holes of the immersion nozzle is 4900 $mm^2$ (70 mm×70 mm), a blow-off amount of an inert gas from the inner wall surface of the immersion nozzle is 12 L/min, and viscosity of the used mold flux (1300° C.) is 0.6 cp.

With respect to the cast slabs, using an ultrasonic flaw detector, the number of mold-flux-caused defects having a particle size of approximately 80 μM or more which are present at a depth position of 2 to 3 mm from a slab surface layer is measured, and the degree of the occurrence of defects is indicated by indexes. It is understood from FIG. 6 that, according to an exemplary method of the present invention, by particularly setting the nozzle inner diameter of the immersion nozzle 2 to a value which falls within a range from 70 to 90 mm, the mold-flux-caused defects can be reduced more effectively.

Further, the opening area of the respective molten steel discharge holes 20 of the immersion nozzle 2 is preferably set to 3600 to 8200 $mm^2$. The reason that the opening area of the molten steel discharge hole 20 influences the advantageous effect of the present invention is that, when the opening area of the molten steel discharge hole 20 is excessively small, flow velocity of molten steel discharged from the molten steel discharge hole 20 becomes excessively large, while when the opening area of the molten steel discharge hole 20 becomes excessively large, to the contrary, the flow velocity of molten steel discharged from the molten steel discharge hole 20 becomes excessively small and hence, flow velocity of a molten steel flow in the mold cannot be appropriately controlled in either case.

Figure 7:
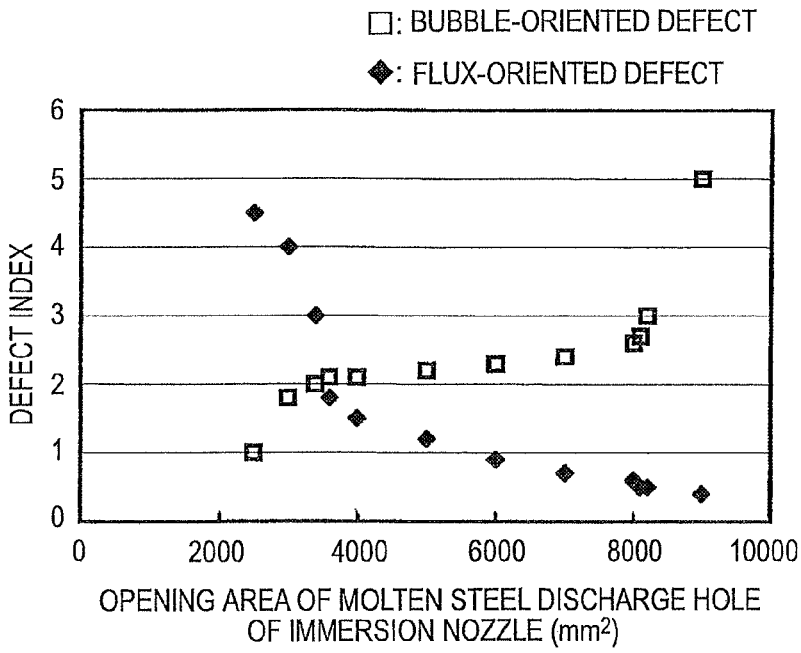
FIG. 7 is a graph showing the influence of an opening area of respective molten steel discharge holes of the immersion nozzle (influence which is exerted on mold-flux-caused defects and bubble-caused defects) in an exemplary method of the present invention.

FIG. 7 shows the result examined for the influence of the opening area of the respective molten steel discharge holes of the immersion nozzle 2 (influence which is exerted on mold-flux-caused defects and bubble-caused defects) in an exemplary method of the present invention, and shows an inspection result under casting conditions where the molten steel discharge angle $\alpha$ of the molten steel discharge hole of the immersion nozzle is 15°, a slab width: 1300 mm, a slab thickness is 260 mm, casting speed is 2.0 m/min, intensity of a DC magnetic field of the upper magnetic pole is 0.14 T, and intensity of a DC magnetic field of the lower magnetic pole is 0.38 T. Other casting conditions are such that a nozzle immersing depth of the immersion nozzle is 260 mm, an inner diameter of the immersion nozzle is 80 mm, a blow-off amount of an inert gas from the inner wall surface of the immersion nozzle is 12 L/min, and viscosity of the used mold flux (1300° C.) is 0.6 cp.

With respect to the cast slabs, using an ultrasonic flaw detector, the respective numbers of bubble-caused defects and mold-flux-caused defects having a particle size of approximately 80 μm or more which are present at a depth position of 2 to 3 mm from a slab surface layer are measured, and the degree of the occurrence of defects is indicated by indexes. It is understood from FIG. 7 that, according to an exemplary method of the present invention, by particularly setting the opening area of each molten steel discharge hole 20 of the immersion nozzle 2 to a value which falls within a range from 3600 to 8200 $mm^2$, the bubble-caused defects and the mold-flux-caused defects can be reduced more effectively.

Other preferred casting conditions are as follows.

The mold flux used in the method may preferably have viscosity of 0.4 to 10 cp at 1300° C. When viscosity of the mold flux is excessively high, the smooth casting may be impaired, while when viscosity of the mold flux is excessively low, the entrainment of the mold flux is liable to occur.

In carrying out the present invention, it is preferable to perform an automatic control of intensities of a DC magnetic field applied to the upper magnetic poles and the lower magnetic poles using a control-use computer in such a manner that values of DC currents to be supplied to respective DC magnetic field coils of the upper magnetic poles and the lower magnetic poles are obtained using a preset cross-reference table or numerical formulae based on slab width of a slab to be cast, a casting speed, a molten steel discharge angle in the downward direction from the horizontal direction of the molten steel discharge hole of the immersion nozzle and the like, and DC currents are supplied to the respective DC magnetic field coils thus applying DC magnetic fields to the upper magnetic poles and the lower magnetic poles. Further, as the casting conditions which become a basis for obtaining the above-mentioned current values, an immersing depth of the immersion nozzle (a distance from a meniscus to an upper end of the molten steel discharge hole), a slab thickness, a blow-off amount of an inert gas from the inner wall surface of the immersion nozzle may be added.

Figure 8:
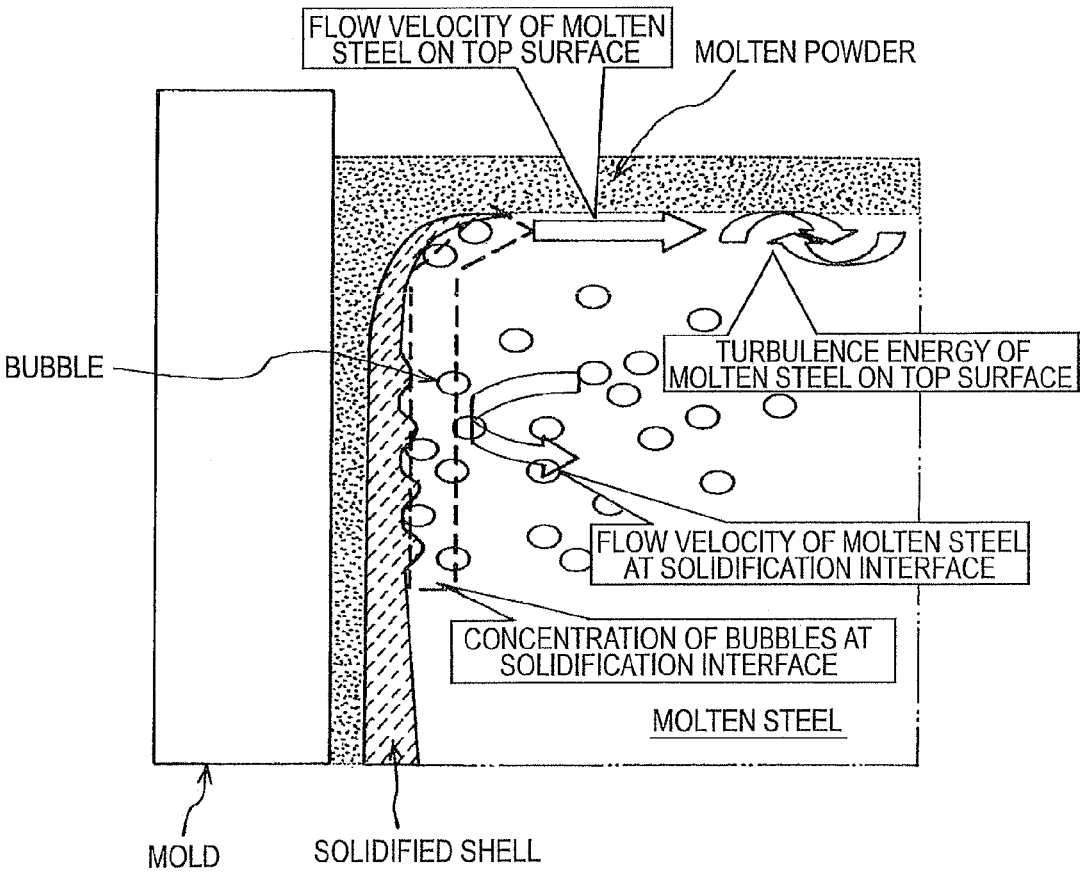
FIG. 8 is a conceptual view for explaining turbulence energy of molten steel on top surface, flow velocity of molten steel at solidification interface (flow velocity of molten steel at molten steel-solidified shell interface), flow velocity of molten steel on top surface, and concentration of bubbles at solidification interface (concentration of bubbles at molten steel-solidified shell interface) of molten steel in a mold.

FIG. 8 is a conceptual view for showing turbulence energy of molten steel on top surface, flow velocity of molten steel at solidification interface (flow velocity of molten steel at molten steel-solidified shell interface), flow velocity of molten steel on top surface, and concentration of bubbles at solidification interface (concentration of bubbles at molten steel-solidified shell interface) of molten steel in a mold.

Turbulence energy of molten steel on top surface of molten steel is a space average value of a k value obtained by the following formula, and is defined by the flow simulation using a numerical value analysis based on a three-dimensional k-c model defined by fluid dynamics. It is noted that a blow-off speed of an inert gas (for example, Ar) which takes into account a molten steel discharge angle, a nozzle immersing depth and a volumetric expansion of the immersion nozzle should be considered. For example, a volumetric expansion rate when a blow-off speed of inert gas is 15 NL/min is increased 6 times. That is, the numerical value analysis model is a model which connects kinetic momentum, the equation of continuity, a turbulence flow k-ϵ model and a Lorentz force in magnetic field, and takes into account a nozzle blow-off lift effect (literature: based on description relating to a two formula model in pages 129 and succeeding pages of "Handbook on Numerical Value Fluid Dynamics" (published on Mar. 31, 2003)).

$$k = \frac{1}{2}\left(\overline{v_X'^2} + \overline{v_Y'^2} + \overline{v_Z'^2}\right), \quad \text{[Eq. 1]}$$

wherein

V'x=∂Vx/∂t

V'y=∂Vy/∂t

V'z=∂Vz/∂t

Vx: flow velocity in X direction on surface of molten steel (bath surface) [m/s]

Vy: flow velocity in Y direction on surface of molten steel (bath surface) [m/s]

Vz: flow velocity in Z direction on surface of molten steel (bath surface) [m/s]

A space average value of flow velocity of molten steel at a position below a meniscus by 50 mm where a solid phase ratio fs is 0.5 is used as flow velocity of molten steel at solidification interface (flow velocity of molten steel at molten steel-solidified shell interface). Here, solidification latent heat and heat transfer should be taken into account and, further, temperature dependency of viscosity of molten steel should be also taken into account with respect to flow velocity of molten steel at solidification interface. According to the detailed calculation carried out by the inventors of the present invention, it is found that flow velocity of molten steel at solidification interface at the solid phase ratio fs of 0.5 corresponds to ½ of flow velocity of molten steel at solidification interface at a dendrite inclination angle (fs=0). That is, when flow velocity of molten steel at solidification interface is 0.1 m/sat the solid phase ratio fs of 0.5 (fs=0.5) by calculation, flow velocity of molten steel at solidification interface at a dendrite inclination angle (fs=0) of a slab becomes 0.2 m/s. Flow velocity of molten steel at solidification interface at the dendrite inclination angle (fs=0) of the slab is obtained by measuring flow velocity of molten steel at solidification interface at a position where the solid phase ratio fs of a front surface of the solidified shell is 0. Here, the dendrite inclination angle means a primary-branch inclination angle of dendrite which extends in the thickness direction from a surface of a slab with respect to a direction normal to the surface of the slab (literature: "Relationship between large-sized inclusions in continuous cast slab and growth direction of columnar crystals of continuously cast slab" in volume 14, 1975, Iron and Steel, pages 2982 to 2990).

A space average value of flow velocity of molten steel on a surface of molten steel (bath surface) is set as flow velocity of molten steel on top surface. This flow velocity of molten steel on top surface is also defined by the previously-mentioned three-dimensional numerical value analysis model. Although flow velocity of molten steel on top surface agrees with a measured value of resistance obtained using an immersion rod, the measured value of resistance becomes an area average position of the immersion rod according to this definition and hence, flow velocity of molten steel on top surface can be calculated by the numerical value calculation.

To be more specific, the numerical value analysis of turbulence energy of molten steel on top surface, flow velocity of molten steel at solidification interface and flow velocity of molten steel on top surface can be carried out as follows. That is, these values can be obtained by calculation based on a general-use fluid analysis program Fluent or the like, for example, using a model which takes into account the kinetic momentum, the equation of continuity and a turbulence flow model (k-ϵ model) associated with the magnetic field analysis and the gas bubbles distribution as a numerical value analysis model (literature: based on the description of a user manual of Fluent 6.3 (Fluent Inc. USA)).

Figure 9:
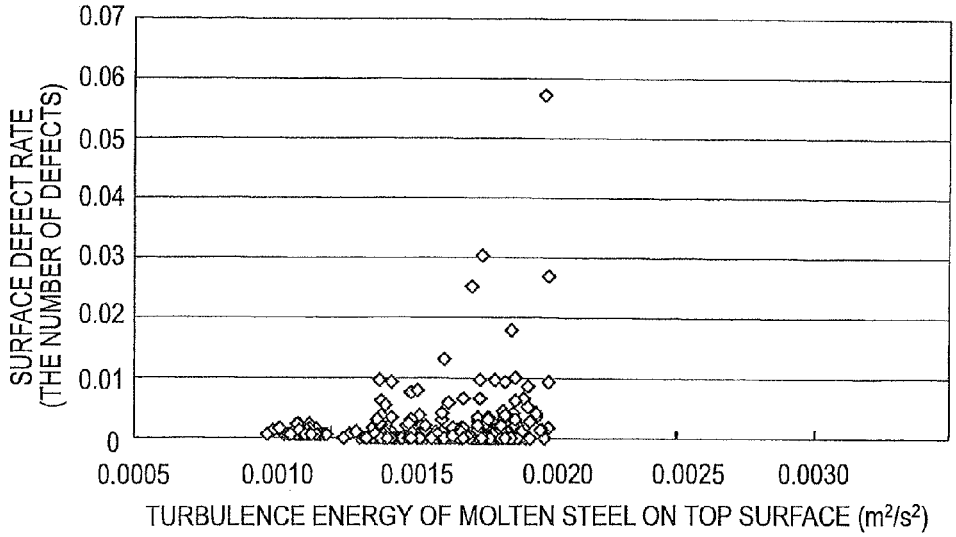
FIG. 9 is a graph showing the relationship between turbulence energy of molten steel on top surface and a surface defect rate (the number of defects) of molten steel in the mold.

The turbulence energy of molten steel on top surface largely influences the entrainment of a mold flux. That is, when the turbulence energy of molten steel on top surface is increased, the entrainment of the mold flux is liable to occur so that the mold-flux-caused defects are increased. On the other hand, when the turbulence energy of molten steel on top surface is excessively small, the slagging of the mold flux becomes insufficient. FIG. 9 shows the relationship between turbulence energy of molten steel on top surface and a surface defect rate (the number of defects per 1 m of coil length measured by a technique equal to a technique used in examples described later). With respect to other conditions, the flow velocity of molten steel at solidification interface is set to a value which falls within a range from 0.08 to 0.15 m/s, the flow velocity of molten steel on top surface is set to a value which falls within a range from 0.05 to 0.30 m/s, and the concentration of bubbles at solidification interface is set to 0.008 kg/m$^3$ or less. According to FIG. 9, when turbulence energy of molten steel on top surface is set to a value which falls within a range from 0.0010 to 0.0015 m$^2$/s$^2$, the entrainment of the mold flux can be effectively suppressed, and there is no problem in slagging of the mold flux.

Figure 10:
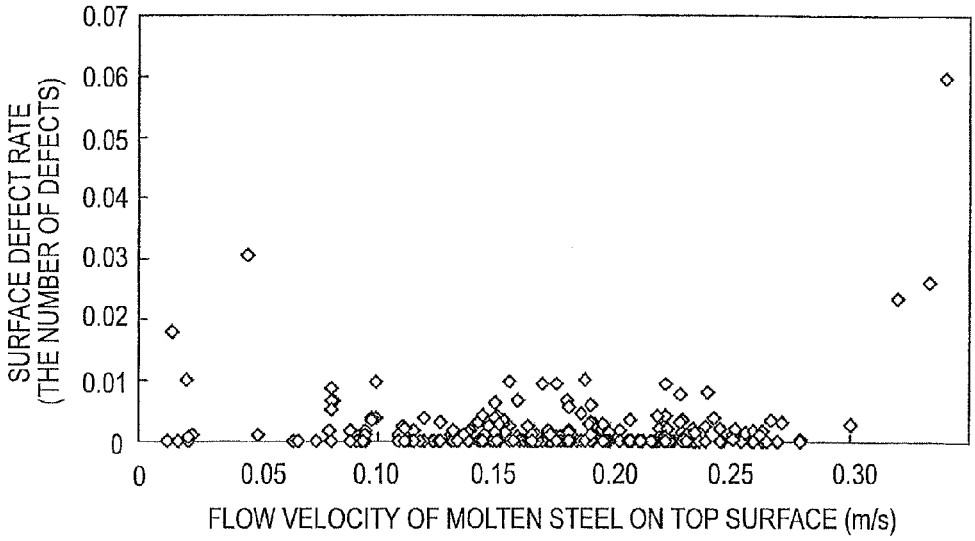
FIG. 10 is a graph showing the relationship between flow velocity of molten steel on top surface and a surface defect rate (the number of defects) of molten steel in the mold.

The flow velocity of molten steel on top surface also largely influences the entrainment of a mold flux. That is, when the flow velocity of molten steel on top surface is increased, the entrainment of the mold flux is liable to occur so that the mold-flux-caused defects are increased. FIG. 10 shows the relationship between the flow velocity of molten steel on top surface and a surface defect rate (the number of defects per 1 m of coil length measured by a technique equal to a technique used in examples described later). With respect to other conditions, the turbulence energy of molten steel on top surface is set to a value which falls within a range from 0.0010 to 0.0015 m$^2$/s$^2$, the flow velocity of molten steel at solidification interface is set to a value which falls within a range from 0.08 to 0.15 m/s, and the concentration of bubbles at solidification interface is set to 0.008 kg/m$^3$ or less. According to FIG. 10, when the flow velocity of molten steel on top surface falls within a range of 0.30 m/s or less, the entrainment of the mold flux can be effectively suppressed. Accordingly, the flow velocity of molten steel on top surface is preferably set to 0.30 m/s or less. Here, when the flow velocity of molten steel on top surface is excessively small, a region where a temperature of a surface of molten steel is lowered is generated and hence, inclusion of slag or partial solidification of molten steel is accelerated due to lack of melting of the mold flux whereby the steel making operation becomes difficult. Accordingly, the flow velocity of molten steel on top surface is preferably set to 0.05 m/s or more.

Figure 11:
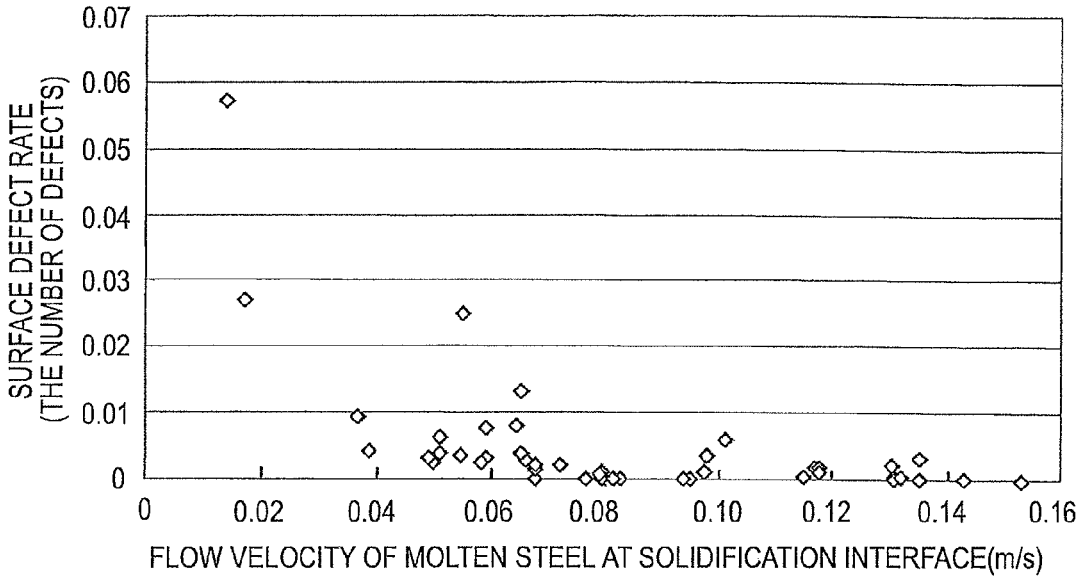
FIG. 11 is a graph showing the relationship between flow velocity of molten steel at solidification interface (flow velocity of molten steel at molten steel-solidified shell interface) and a surface defect rate (the number of defects) of molten steel in the mold.

The flow velocity of molten steel at solidification interface largely influences the catching of bubbles or the inclusions in the solidified shell. That is, when the flow velocity of molten steel at solidification interface is small, bubbles or the inclusions are liable to be caught in the solidified shell so that the bubble-caused defects and the like are increased. On the other hand, when the flow velocity of molten steel at solidification interface is excessively large, re-melting of the formed solidified shell occurs thus impairing the growth of the solidified shell. In the worst case, a breakout is brought about so that a steel making operation is stopped leading to a fatal problem on productivity. FIG. 11 shows the relationship between flow velocity of molten steel at solidification interface and a surface defect rate (the number of defects per 1 m of coil length measured by a technique equal to a technique used in examples described later). With respect to other conditions, the turbulence energy of molten steel on top surface is set to a value which falls within a range from 0.0010 to 0.0015 m$^2$/s$^2$, the flow velocity of molten steel on top surface is set to a value which falls within a range from 0.05 to 0.30 m/s, and the concentration of bubbles at solidification interface is set to 0.008 kg/m$^3$ or less. According to FIG. 11, when flow velocity of molten steel at solidification interface is set to a value which falls within from 0.08 to 0.15 m/s, the catching of the bubbles in the solidified shell can be effectively suppressed, and a problem such as breakout caused by the impairment of the growth of the solidified shell does not occur.

Figure 12:
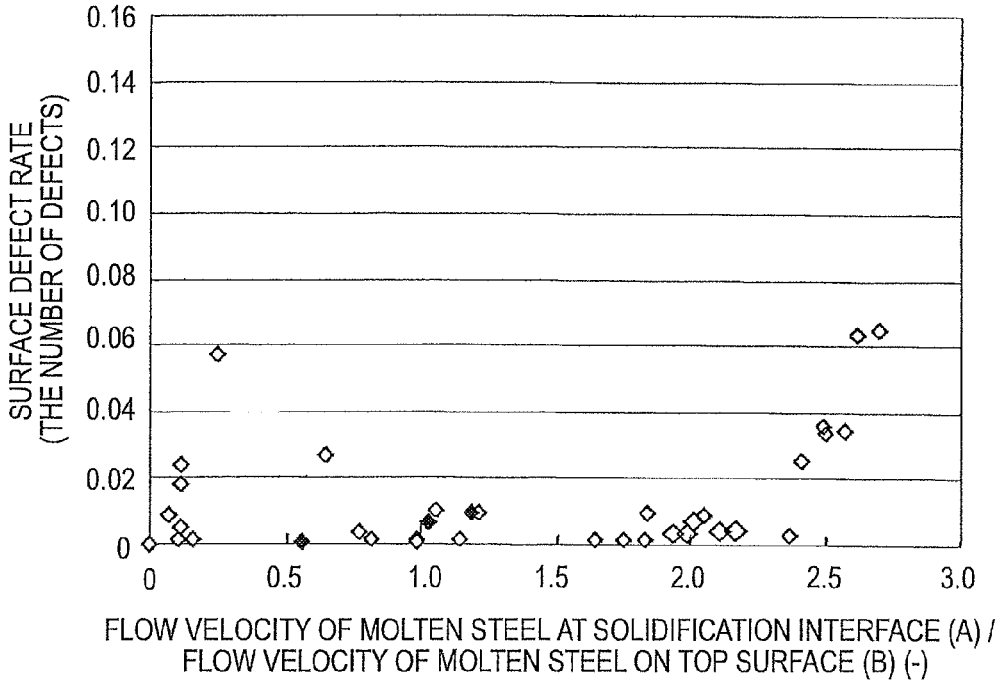
FIG. 12 is a graph showing the relationship between a ratio A/B between flow velocity of molten steel at solidification interface A and flow velocity of molten steel on top surface B and a surface defect rate (the number of defects) of molten steel in the mold.

A ratio A/B between the flow velocity of molten steel at solidification interface A and the flow velocity of molten steel on top surface B influences both of the catching of bubbles and the entrainment of a mold flux. That is, when the ratio A/B is small, bubbles and the inclusions are liable to be caught in the solidified shell so that the bubble-caused defects and the like are increased. On the other hand, the ratio A/B is excessively large, the entrainment of a mold powder is liable to occur so that the mold-flux-caused defects are increased. FIG. 12 shows the relationship between a ratio A/B and a surface defect rate (the number of defects per 1 m of coil length measured by a technique equal to a technique used in examples described later). With respect to other conditions, the turbulence energy of molten steel on top surface is set to a value which falls within a range from 0.0010 to 0.0015 m$^2$/s$^2$, the flow velocity of molten steel on top surface is set to a value which falls within a range from 0.05 to 0.30 m/s, the flow velocity of molten steel at solidification interface is set to a value which falls within a range from 0.08 to 0.15 m/s, and concentration of bubbles at solidification interface is set to 0.008 kg/m$^3$ or less. According to FIG. 12, the occurrence of the surface quality defects can be particularly preferably prevented when the ratio A/B falls within a range from 1.0 to 2.0. Accordingly, a ratio A/B between flow velocity of molten steel at solidification interface A and flow velocity of molten steel on top surface B is preferably set to 1.0 to 2.0.

Due to the reasons described above, it is preferable to set the flow state of the molten steel in the mold such that turbulence energy of molten steel on top surface is 0.0010 to 0.0015 m$^2$/s$^2$, flow velocity of molten steel on top surface is 0.30 m/s or less, and flow velocity of molten steel at molten steel-solidified shell interface is 0.08 to 0.15 m/s. Flow velocity of molten steel on top surface is more preferably set to a value which falls within 0.05 to 0.30 m/s, and a ratio A/B between molten steel at solidification interface A and flow velocity of molten steel on top surface B is preferably set to 1.0 to 2.0.

Further, as another factor which is relevant to the occurrence of bubble-caused defects, concentration of bubbles at molten steel-solidified shell interface (hereinafter, simply referred to as "concentration of bubbles at solidification interface") is named. By properly controlling the concentration of bubbles at solidification interface, the catching of bubbles on solidification interface can be suppressed more properly.

The concentration of bubbles at solidification interface is the concentration of the bubbles having a diameter of 1 mm at a position below a meniscus by 50 mm where a solid phase ratio fs is 0.5, and the concentration of bubbles at solidification interface is defined by the previously mentioned numerical value calculation. Here, the number N of bubbles blown off to the nozzle on calculation can be calculated as N=AD−5, wherein A is a blow-off gas speed, and D is a diameter of a bubble (literature: ISIJ Int. Vol. 43 (2003), No. 10, p. 1548-1555). The blow-off gas speed is generally 5 to 20 Nl/min in general.

Figure 13:
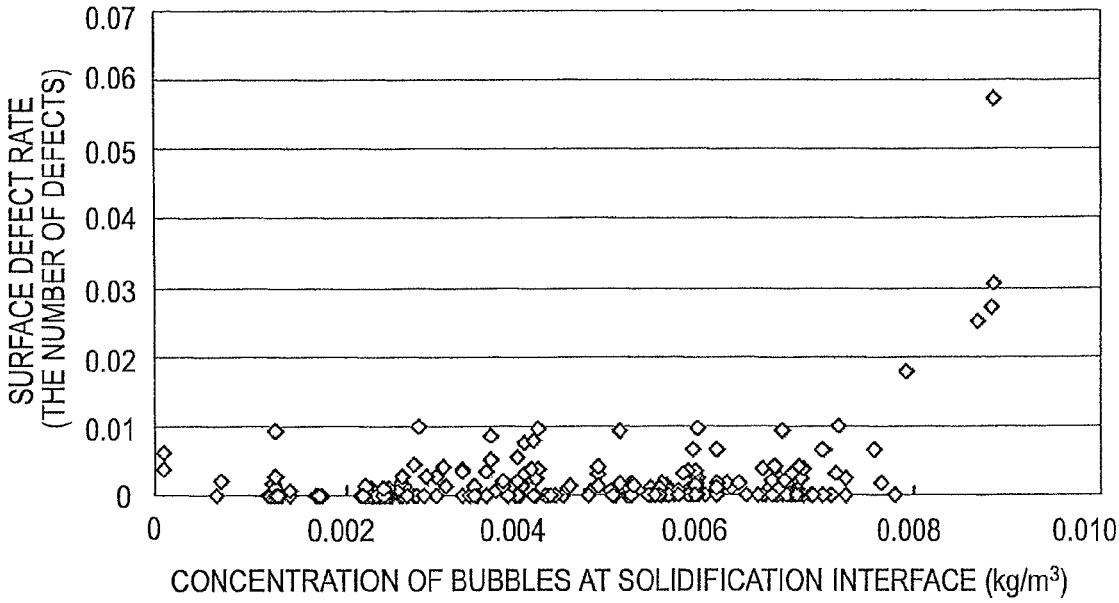
FIG. 13 is a graph showing the relationship between concentration of bubbles at solidification interface (concentration of bubbles at molten steel-solidified shell interface) and a surface defect rate (the number of defects) of molten steel in the mold.

The concentration of bubbles at solidification interface largely influences the catching of bubbles. That is, when the concentration of bubbles is high, an amount of bubbles caught in the solidified shell is increased. FIG. 13 shows the relationship between concentration of bubbles at solidification interface and a surface defect rate (the number of defects per 1 m of coil length measured by a technique equal to a technique used in examples described later). With respect to other conditions, the turbulence energy of molten steel on top surface is set to a value which falls within a range from 0.0010 to 0.0015 $m^2/s^2$, the flow velocity of molten steel on top surface is set to a value which falls within a range from 0.05 to 0.30 m/s, and the flow velocity of molten steel at solidification interface is set to a value which falls within a range from 0.08 to 0.15 m/s. According to FIG. 13, when the concentration of bubbles at solidification interface falls within a range of 0.008 $kg/m^3$ or less, the amount of bubbles caught in the solidified shell can be suppressed at a low level. Accordingly, concentration of bubbles at solidification interface is preferably set to 0.008 $kg/m^3$ or less.

The concentration of bubbles at solidification interface can be controlled by a slab thickness of a slab to be cast and a blow-off amount of an inert gas from the inner wall surface of the immersion nozzle, and the thickness of a slab to be cast is preferably set to 220 mm or more, and the blow-off amount of an inert gas from the inner wall surface of the immersion nozzle is preferably set to 25 NL/min or less.

Bubbles follow molten steel which is discharged from the molten steel discharge hole 20 of the immersion nozzle 2 and hence, when a slab thickness is excessively small, the molten steel flow discharged from the molten steel discharge hole 20 approaches the solidified shell 5 on the long side portion side of the mold so that the concentration of bubbles at solidification interface becomes high whereby the bubbles are liable to be caught in the interface of the solidified shell. Particularly, when the thickness of the slab is less than 220 mm, even when an electromagnetic flow control of the molten steel flow is carried out, the control of the distribution of bubbles becomes difficult due to the reason set forth above. On the other hand, when the thickness of the slab exceeds 300 mm, there arises a drawback that the productivity in a hot rolling step becomes low. Accordingly, a slab thickness of a slab to be cast is preferably set to a value which falls within a range from 220 to 300 mm.

When a blow-off amount of an inert gas from the inner wall surface of the immersion nozzle 2 is increased, the concentration of bubbles at solidification interface becomes high and hence, the bubbles are liable to be caught in the interface of the solidification shell. Particularly, when the blow-off amount of an inert gas exceeds 20 NL/min, even when an electromagnetic flow control of the molten steel flow according to embodiments of the present invention is carried out, the control of the distribution of bubbles becomes difficult due to the reason set forth above. On the other hand, when the blow-off amount of an inert gas is excessively small, the clogging of the nozzle is liable to occur and a biased flow becomes large and hence, the control of the flow velocity becomes difficult to the contrary. Accordingly, the blow-off amount of an inert gas from the inner wall surface of the immersion nozzle 2 is preferably set to a value which falls within a range from 3 to 25 NL/min.

Next, the explanation is made with respect to a method for manufacturing a steel sheet using a slab produced by casting by the above-mentioned continuous casting method according to embodiments of the present invention (the continuous casting method where a slab is cast such that steel is continuously cast using the continuous casting machine where the pair of upper magnetic poles which is arranged so that the upper magnetic poles face each other with the mold long-side portion sandwiched therebetween and the pair of lower magnetic poles which is arranged so that the lower magnetic poles face each other with the mold long-side portion sandwiched therebetween are provided to the outer side of the mold, and the molten steel discharge holes are positioned between the peak position of the magnetic field of the upper magnetic poles and the peak position of the magnetic field of the lower magnetic poles while braking a molten steel flow by a DC magnetic field applied to the pair of upper magnetic poles and the pair of lower magnetic poles). The above-mentioned conditions (A) and (B) for continuous casting are not indispensable to acquire advantageous effects of a manufacturing method of a steel plate of an embodiment of the present invention described below (reduction of blisters). However, it is possible to impart the excellent surface quality to the steel sheet synthetically by combining these conditions.

As described previously, the defects of the cold-rolled steel sheet referred to as blister are surface defects in a swelled shape where hydrogen which invades the steel sheet at the time of pickling after hot rolling and stays in portions such as non-metallic inclusions, bubbles, segregation or inner cracks in the steel sheet after cold rolling expand a volume thereof and increases pressure along with heating at the time of annealing, and deforms the steel sheet softened by heating.

The inventors of the present invention have studied the relationship among the occurrence of such blister, the pickling condition of the hot-rolled steel sheet and cold-rolling condition and also slabs to be used, and have made the following finding as a result of the study.

(1) The hydrogen concentration $H_0$ in a hot-rolled steel sheet immediately after pickling is finished has enough correlation with an amount of weight reduction of the hot-rolled steel sheet by pickling and hence, the hydrogen concentration $H_0$ in the hot-rolled steel sheet immediately after pickling is finished can be obtained based on the amount of weight reduction by pickling.

(2) The hydrogen concentration $H_1$ (mass ppm) in the hot-rolled steel sheet at a point of time p where a time $t_1$ (seconds) elapses after pickling is finished can be expressed by the following formula (i) based on the relationship between the hydrogen concentration $H_0$ (mass ppm) in the hot-rolled steel sheet immediately after pickling is finished and a maximum surface temperature $T_1$ (K) of the steel sheet until the point of time p after pickling is finished. Accordingly, assuming the time $t_1$ in the following formula (i) as "time t till starting of cold rolling after pickling is finished" and the maximum surface temperature $T_1$ as "maximum surface temperature T of the steel sheet before starting cold rolling after pickling is finished", hydrogen concentration H in the steel sheet immediately before cold rolling can be obtained.

$$H_1 = H_0 \cdot \exp[-0.002 \times (T_1 + t_1/100)] \quad \text{(i)}$$

(3) Whether or not a surface quality defect of a steel sheet caused by blister occurs is determined based on the hydrogen concentration H in the steel sheet immediately before cold rolling and cold rolling conditions (rolling reduction condition), and "critical hydrogen concentration Hc in the steel sheet immediately before cold rolling" at which a surface quality defect (defective surface quality) caused by blister occurs is determined corresponding to the cold rolling conditions.

(4) From the above, by controlling the time t from finishing of pickling to starting of cold rolling and/or the maximum surface temperature T of the steel sheet such that the hydrogen concentration H in the steel sheet immediately before cold rolling obtained by the above formula (i) does not become the critical hydrogen concentration Hc, the occurrence of blister can be suppressed and hence, the occurrence of surface quality defect (defective surface quality) caused by blister can be prevented.

(5) By casting a slab by the above-mentioned continuous casting method according to an embodiment of the present invention, defects caused by the entrainment of non-metallic inclusions and a mold flux (so-called sliver defects) can be decreased, and defects caused by the entrainment of minute bubbles can be also decreased. However, it is difficult to surely prevent the entrainment of more minute bubbles (bubbles having a bubble diameter of 5 mm or less, for example) and inclusions so that such minute bubbles and minute inclusions get in the inside of the steel sheet and induce defects in a swelled shape due to hydrogen ($H_2$) using the minute bubbles or minute inclusions as an initiation point (blister defect). To cope with such a drawback, by combining the continuous casting method of the present invention with the method described in the above (4), that is, by applying pickling and cold rolling to the hot-rolled steel sheet obtained by rolling the slab produced by casting by the above-mentioned continuous casting method according to the present invention under the condition in the above-mentioned (4), it is possible to manufacture a steel sheet having high quality with extremely small surface defects caused by the entrainment of bubbles, inclusions and a mold flux while including blisters caused by the entrainment of extremely minute bubbles and minute inclusions.

According to the method for manufacturing a steel sheet of the present invention which is made based on such finding, a hot-rolled steel sheet is obtained by hot rolling a slab produced by casting using the above-mentioned continuous casting method according to the present invention, the hot-rolled steel sheet is subject to pickling and, thereafter, in applying cold rolling to the hot-rolled steel sheet, time t and/or a maximum surface temperature T of the steel sheet is controlled so as to satisfy a following formula (1a).

$$Hc/Ho > \exp\{-0.002\times(T+t/100)\} \quad (1a)$$

Here, Ho: hydrogen concentration (mass ppm) in steel sheet immediately after pickling is finished Hc: critical hydrogen concentration (mass ppm) in steel sheet immediately before cold rolling at which surface quality defects occur by blister, the critical hydrogen concentration being determined based on cold rolling conditions t: time until cold rolling starts after pickling is finished (seconds)

T: maximum surface temperature T (K) of steel sheet before cold rolling starts (the steel sheet surface temperature also includes steel sheet surface temperature when the steel sheet is heated after pickling is finished and before cold rolling)

The above-mentioned manufacturing method of a steel sheet is effectively applicable to a case where the manufacturing method is carried out in a pickling and cold-rolling continuous line (PPCM line, PPCM; Pickling and Profile-Control Cold Mill) where steps ranging from pickling to cold rolling are continuously carried out. This is because blister is particularly liable to occur in a steel sheet which is manufactured in such a PPCM line.

In the above-mentioned explanation, actually measured values of the hydrogen concentration in the steel sheet are values obtained in such a manner that a temperature of the steel sheet is elevated to 800° C., and hydrogen discharged from the steel sheet is analyzed by a mass spectrometer.

Figure 14:
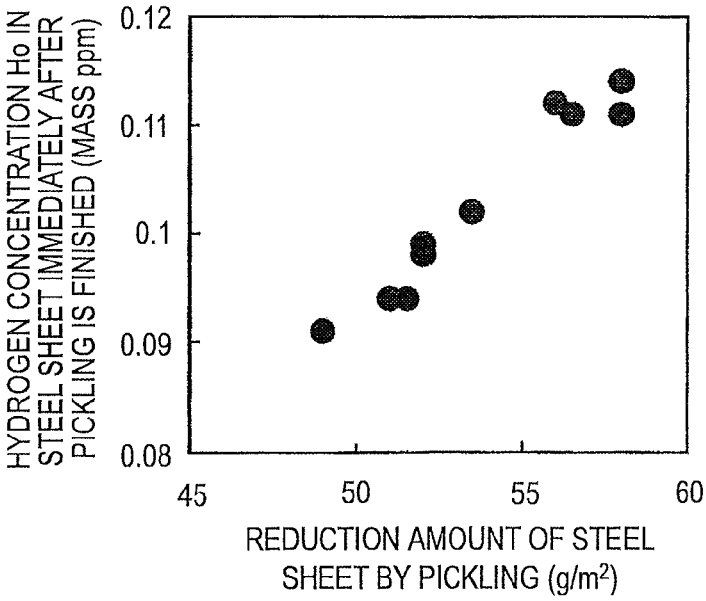
FIG. 14 is a graph showing the relationship between a weight reduction amount of a hot-rolled steel sheet by pickling and the hydrogen concentration H0 in a steel sheet immediately after pickling is finished.

Table 2 shows a result obtained by pickling a hot-rolled steel sheet under various conditions in a pickling facility where five pickling baths are arranged in series and by investigating a weight reduction amount of a steel sheet by pickling and hydrogen concentration $H_0$ in the steel sheet immediately after pickling is finished. FIG. 14 shows the relationship between the weight reduction amount of the steel sheet by pickling and the hydrogen concentration $H_0$ in the steel sheet immediately after pickling is finished based on such a result. The pickling conditions are constituted of acid concentration, pickling temperature and pickling time. As shown in Table 2, no dependency of the weight reduction amount of the steel sheet by pickling on the pickling condition is observed. It is considered that the weight reduction amount of the steel sheet by pickling changes depending on a surface state (scale thickness or the like) of the steel sheet before pickling. On the other hand, the hydrogen concentration $H_0$ in the steel sheet immediately after pickling is finished has sufficient correlation with the weight reduction amount of the steel sheet by pickling as shown in FIG. 14. Accordingly, the hydrogen concentration $H_0$ in the steel sheet immediately after pickling is finished can be obtained based on the weight reduction amount of steel sheet by pickling.

Figure 15:
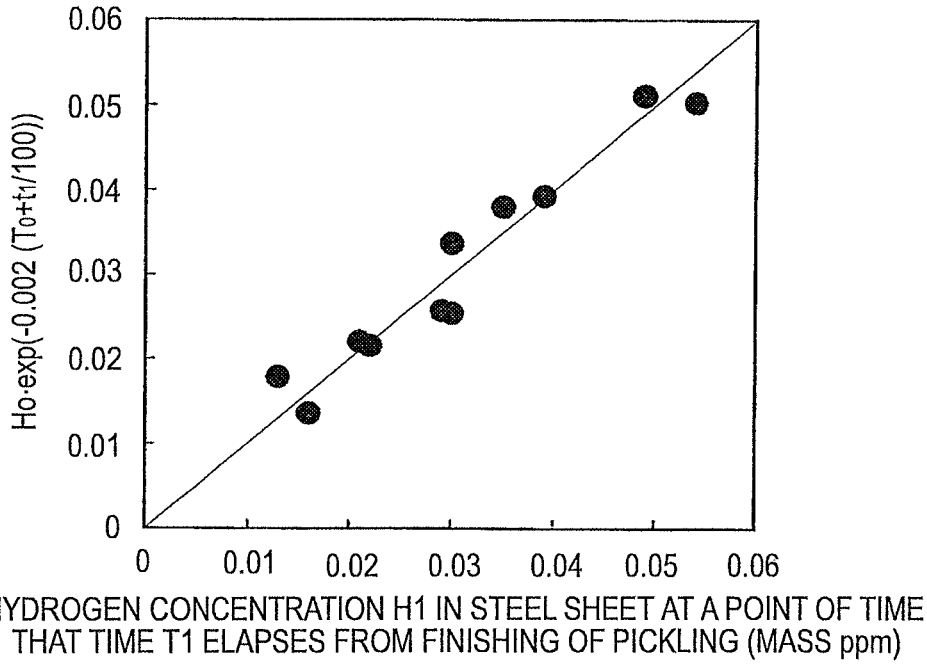
FIG. 15 is a graph showing the relationship between $H_0 \cdot \exp\{-0.002\times(T_0+t_1/100)\}$ and the hydrogen concentration $H_1$ in a steel sheet at a point of time that a time $t_1$ elapses from finishing of pickling assuming hydrogen concentration in a hot-rolled steel sheet immediately after pickling is finished as $H_0$ and a steel sheet surface temperature as $T_0$.

By measuring the steel sheet surface temperature $T_0$ as well as the hydrogen concentration $H_0$ in the hot-rolled steel sheet immediately after finishing picking respectively and also by measuring the hydrogen concentration $H_1$ in the steel sheet at a point of time where a time $t_1$ elapses from finishing of pickling of the hot-rolled steel sheet, a result shown in Table 3 is obtained. Based on the result shown in Table 3, it is understood that hydrogen is discharged from the hot-rolled steel sheet on which pickling is already finished with time and that there exists the relationship expressed by the following formula (ii) in approximation among the hydrogen concentration $H_0$ (mass ppm) in the hot-rolled steel sheet, the hydrogen concentration $H_1$ (mass ppm) in the hot-rolled steel sheet, time $t_1$ (seconds) and the steel sheet surface temperature $T_0$ (K). FIG. 15 shows the relationship between $H_0\cdot\exp\{-0.002\times(T_0+t_1/100)\}$ and the hydrogen concentration $H_1$ in the steel sheet at a point of time where the time $t_1$ elapses from finishing of pickling. The reason that the hydrogen concentration $H_1$ in the steel sheet is influenced by not only the time $t_1$ but also the steel sheet surface temperature $t_0$ immediately after pickling is finished is that a discharge amount of hydrogen is particularly influenced (controlled) by a steel sheet temperature, and, particularly, by the arrived maximum temperature, and the highest steel sheet temperature (arrived maximum temperature) is taken immediately after pickling is finished under the above-mentioned test condition.

$$H_1 = Ho\cdot\exp[-0.002\times(T_0+t_1/100)] \quad (ii)$$

Accordingly, when the steel sheet is heated to a temperature higher than the steel sheet temperature immediately after pickling is finished after pickling and before starting cold rolling, the steel sheet surface temperature $T_0$ in the above-mentioned formula (ii) becomes the steel sheet surface temperature at the time of such heating (arrived maximum temperature). This is because, as described above, a discharge amount of hydrogen from the hot-rolled steel sheet after pickling is finished is influenced (controlled) by the arrived maximum temperature of the steel sheet.

From the above, it is found that the hydrogen concentration $H_1$ (mass ppm) in the hot-rolled steel sheet at a point of time p where the time $t_1$ (seconds) elapses after pickling is finished can be expressed by the following formula (i) based on the relationship between the hydrogen concentration $H_0$ (mass ppm) in the hot-rolled steel sheet immediately after pickling is finished and a maximum surface temperature $T_1$ (K) of the steel sheet between the finishing of pickling and the point of time p. Accordingly, assuming the time $t_1$ in the following formula (i) as "time t till starting of cold rolling after pickling is finished" and the maximum surface temperature $T_1$ as "maximum surface temperature T of the steel sheet after pickling is finished and before starting cold rolling", hydrogen concentration H in the steel sheet immediately before cold rolling can be obtained.

$$H_1=H_0\cdot\exp[-0.002\times(T_1+t_1/100)] \quad \text{(i)}$$

On the other hand, it is found that whether or not a surface quality defect caused by blister occurs is determined based on the hydrogen concentration H in the steel sheet immediately before cold rolling and a cold rolling condition (rolling reduction condition), and "critical hydrogen concentration Hc in the steel sheet immediately before cold rolling" at which a surface quality defect (defective surface quality) caused by blister occurs is defined corresponding to the cold rolling condition.

Figure 16:
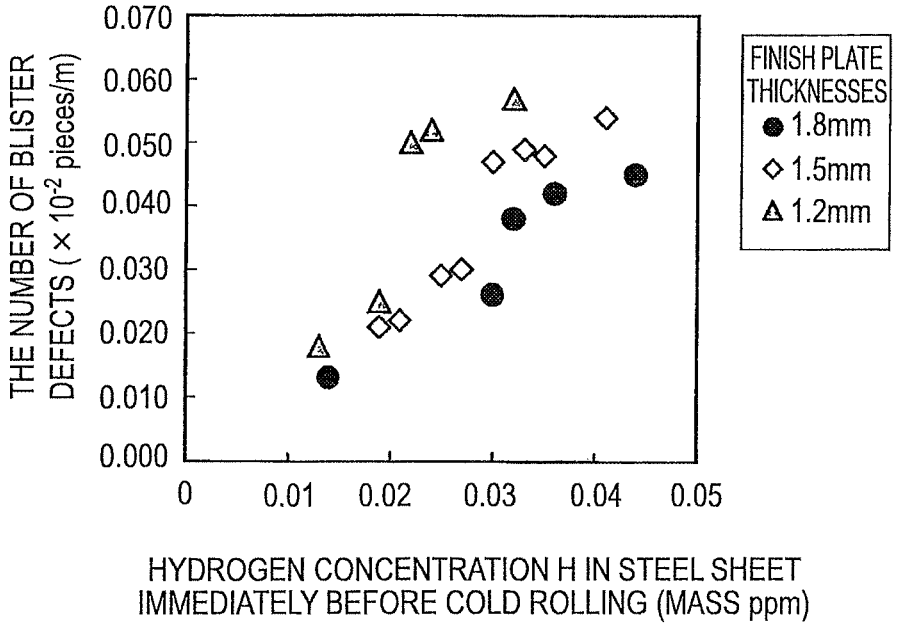
FIG. 16 is a graph showing the relationship between the hydrogen concentration H in a steel sheet immediately before cold rolling and the number of occurrence of blister defects as a graph in terms of a finished plate thickness of a cold-rolled plate.

With respect to the case where the hot-rolled steel sheet having a plate thickness of 4 mm is rolled with various finish plate thicknesses in cold rolling (final plate thicknesses in cold rolling), the hydrogen concentration H in the steel sheet immediately before cold rolling, the finish plate thickness in the cold rolling, and the occurrence number of blister defects are examined. The result shown in Table 4 is obtained. FIG. 16 shows the relationship between the hydrogen concentration H in the steel sheet immediately before cold rolling and the occurrence number of blister defects in terms of the finish plate thickness in cold rolling.

According to the above-mentioned result, it is understood that when the hydrogen concentration H in the steel sheet immediately before cold rolling exceeds a certain value, the number of blister defects is rapidly increased. Further, it is understood that the smaller the finish plate thickness of the steel sheet in cold rolling (that is, the larger the rolling reduction of the steel sheet in cold rolling), the smaller a value of the above-mentioned hydrogen concentration H in the steel sheet immediately before cold rolling at which the blister defects is rapidly increased becomes. It is considered that the higher the hydrogen concentration H in the steel sheet immediately before cold rolling or the larger the rolling reduction of the steel sheet in cold rolling, the larger the elevation of an internal pressure of hydrogen which stays in the inside of the steel sheet becomes. In general, when the number of blister defects exceeds approximately $0.0350\times10^{-2}$ pieces/m, a surface quality defect caused by blister defects becomes apparent and hence, the number of blister defects is set to more than $0.0350\times10^{-2}$ pieces/m as an index of "the occurrence of surface quality defect caused by blisters" (defective surface quality), for example.

From the above, it is found that the "critical hydrogen concentration Hc in the steel sheet immediately before cold rolling" at which the surface quality defect caused by the blisters occur can be decided corresponding to the cold rolling condition (rolling reduction condition). To be more specific, the critical hydrogen concentration Hc in the steel sheet immediately before cold rolling can be decided corresponding to the finish plate thickness decided based on a reduction rate in cold rolling. For example, when a plate thickness of the hot-rolled plate is 4 mm, based on the result shown in FIG. 16, the critical hydrogen concentration Hc in the steel sheet immediately before cold rolling can be determined as follows corresponding to each finish plate thickness in cold rolling.

| Finish plate thickness rolling in cold | Critical hydrogen concentration Hc in steel plate |
|---|---|
| 1.8 mm | 0.030 mass ppm |
| 1.5 mm | 0.025 mass ppm |
| 1.2 mm | 0.020 mass ppm |

From the above, by controlling the time t from finishing of pickling to starting of cold rolling and the maximum surface temperature T of the steel sheet such that the hydrogen concentration in the steel sheet immediately before cold rolling does not become the critical hydrogen concentration Hc corresponding to the cold rolling condition, the occurrence of surface quality defect caused by blisters can be prevented. Accordingly, in the present invention, in carrying out cold rolling after pickling the hot-rolled steel sheet, the time t and/or the maximum surface temperature T of the steel sheet is/are preferably controlled so as to satisfy the following formula (1a).

$$Hc/Ho>\exp\{-0.002\times(T+t/100)\} \quad \text{(1a)}$$

Here, Ho: hydrogen concentration (mass ppm) in a steel sheet immediately after pickling is finished Hc: critical hydrogen concentration (mass ppm) in steel sheet immediately before cold rolling at which surface quality defects occur by blister, the critical hydrogen concentration being determined based on cold rolling conditions t: time until cold rolling starts after pickling is finished (seconds)

T: maximum surface temperature T (K) of steel sheet before cold rolling starts (the steel sheet surface temperature also includes steel sheet surface temperature when the steel sheet is heated after pickling is finished and before cold rolling)

In such a method of the present invention, as described above, it is preferred to set in advance "critical hydrogen concentration Hc in the steel sheet immediately before cold rolling" corresponding to the cold rolling condition (rolling reduction condition). Further, it is preferable to obtain in advance the relationship between a weight reduction amount of steel sheet by pickling and the hydrogen concentration Ho in the steel sheet immediately after pickling.

As the hot-rolled steel sheet, a hot-rolled steel plate obtained by hot-rolling a slab produced by casting using the above-mentioned continuous casting method of the present invention is used. Accordingly, due to the reason set forth in (5), it is possible to manufacture a steel sheet having high quality which has extremely small surface defects caused by the entrainment of bubbles, inclusions and a mold flux including blisters caused by the entrainment of extremely minute bubbles and minute inclusions.

In carrying out an exemplary method of the present invention, for example, the steel sheet after pickling is finished is left in a coil state at a room temperature, and cold rolling is carried out after the lapse of time t which satisfies the above-mentioned formula (1a). Further, by elevating the maximum surface temperature T of the steel sheet by heating the hot-rolled steel sheet after pickling is finished, the time t which satisfies the above-mentioned formula (1a) can be shortened and hence, the method of the present invention is also applicable to the PPCM line thus enhancing the productivity. For heating the hot-rolled steel sheet, gas burner heating, electric heater heating, high frequency induction heating and the like are applicable. Since cold cooling is performed after such heating, it is preferable to perform heating in an inert gas atmosphere where an oxygen partial pressure is controlled. Further, in applying the method of the present invention to a PPCM line, a line speed can be adjusted by using a looper which can change a distance between rolls.

TABLE 4-continued

| No. | Finish plate thickness after cold rolling (mm) | Hydrogen concentration H in steel plate immediately before cold rolling (mass ppm) | Number of blister defects ($\times 10^{-2}$ pieces/m) |
|---|---|---|---|
| 9 | 1.5 | 0.021 | 0.022 |
| 10 | 1.5 | 0.033 | 0.049 |
| 11 | 1.5 | 0.035 | 0.048 |
| 12 | 1.5 | 0.041 | 0.054 |
| 13 | 1.5 | 0.025 | 0.029 |

TABLE 2

| | Pickling condition *1 | | | | | | | | | | | | | | | | |
|---|---|---|---|---|---|---|---|---|---|---|---|---|---|---|---|---|---|
| | First time | | | Second time | | | Third time | | | Fourth time | | | Fifth time | | | | |
| No. | Acid concentration (%) | Temperature (° C.) | Time (sec) | Acid concentration (%) | Temperature (° C.) | Time (sec) | Acid concentration (%) | Temperature (° C.) | Time (sec) | Acid concentration (%) | Temperature (° C.) | Time (sec) | Acid concentration (%) | Temperature (° C.) | Time (sec) | Reduction amount by pickling (g/m$^{2)}$ | Hydrogen concentration $H_0$ in steel plate immediately after finishing pickling (mass %) |
| 1 | 1 | 30 | 9 | 3 | 30 | 9 | 5 | 85 | 9 | 7 | 85 | 9 | 9 | 85 | 9 | 51.0 | 0.094 |
| 2 | 1 | 30 | 9 | 3 | 30 | 9 | 5 | 85 | 9 | 7 | 85 | 9 | 9 | 85 | 9 | 56.5 | 0.111 |
| 3 | 1 | 30 | 9 | 3 | 30 | 9 | 5 | 85 | 9 | 7 | 85 | 9 | 9 | 85 | 9 | 49.0 | 0.091 |
| 4 | 1 | 30 | 9 | 3 | 30 | 9 | 5 | 85 | 9 | 7 | 85 | 9 | 9 | 85 | 9 | 51.5 | 0.094 |
| 5 | 1 | 30 | 9 | 3 | 30 | 9 | 5 | 85 | 9 | 7 | 85 | 9 | 9 | 85 | 9 | 56.0 | 0.112 |
| 6 | 3 | 90 | 8 | 5 | 90 | 8 | 7 | 90 | 8 | 9 | 90 | 8 | — | — | — | 58.0 | 0.111 |
| 7 | 3 | 90 | 8 | 5 | 90 | 8 | 7 | 90 | 8 | 9 | 90 | 8 | — | — | — | 52.0 | 0.099 |
| 8 | 3 | 90 | 8 | 5 | 90 | 8 | 7 | 90 | 8 | 9 | 90 | 8 | — | — | — | 53.5 | 0.102 |
| 9 | 0 | 90 | 6 | 4 | 90 | 12 | 6.5 | 88 | 12 | 9 | 88 | 12 | 11.5 | 88 | 12 | 58.0 | 0.114 |
| 10 | 0 | 90 | 6 | 4 | 90 | 12 | 6.5 | 88 | 12 | 9 | 88 | 12 | 11.5 | 88 | 12 | 52.0 | 0.098 |

*1 Pickling facility is constituted of five pickling baths (in series). "First time", "fifth time" means pickling conditions in five respective pickling baths.

TABLE 3

| N0. | Hydrogen concentration Ho in steel plate immediately after finishing pickling (mass ppm) | Hydrogen concentration $H_1$ in steel plate after lapse of time $t_1$ from pickling (mass ppm) | Time $t_1$ (sec) | Steel plate surface temperature To immediately after finishing pickling (K) | Ho · exp {−0.002 × (T + t/100)} |
|---|---|---|---|---|---|
| 1 | 0.102 | 0.054 | 5400 | 300 | 0.0502 |
| 2 | 0.095 | 0.039 | 14400 | 298 | 0.0392 |
| 3 | 0.090 | 0.022 | 42000 | 295 | 0.0215 |
| 4 | 0.105 | 0.021 | 48000 | 301 | 0.0220 |
| 5 | 0.100 | 0.016 | 70200 | 297 | 0.0136 |
| 6 | 0.111 | 0.049 | 30 | 388 | 0.0511 |
| 7 | 0.102 | 0.030 | 360 | 551 | 0.0336 |
| 8 | 0.100 | 0.013 | 180 | 860 | 0.0178 |
| 9 | 0.100 | 0.035 | 2400 | 460 | 0.0380 |
| 10 | 0.111 | 0.029 | 10800 | 624 | 0.0257 |
| 11 | 0.105 | 0.030 | 21600 | 494 | 0.0254 |

TABLE 4

| No. | Finish plate thickness after cold rolling (mm) | Hydrogen concentration H in steel plate immediately before cold rolling (mass ppm) | Number of blister defects ($\times 10^{-2}$ pieces/m) |
|---|---|---|---|
| 1 | 1.8 | 0.044 | 0.045 |
| 2 | 1.8 | 0.014 | 0.013 |
| 3 | 1.8 | 0.036 | 0.042 |
| 4 | 1.8 | 0.032 | 0.038 |
| 5 | 1.8 | 0.030 | 0.026 |
| 6 | 1.5 | 0.030 | 0.047 |
| 7 | 1.5 | 0.027 | 0.030 |
| 8 | 1.5 | 0.019 | 0.021 |

TABLE 4-continued

| No. | Finish plate thickness after cold rolling (mm) | Hydrogen concentration H in steel plate immediately before cold rolling (mass ppm) | Number of blister defects ($\times 10^{-2}$ pieces/m) |
|---|---|---|---|
| 14 | 1.2 | 0.022 | 0.050 |
| 15 | 1.2 | 0.032 | 0.057 |
| 16 | 1.2 | 0.024 | 0.052 |
| 17 | 1.2 | 0.019 | 0.025 |
| 18 | 1.2 | 0.013 | 0.018 |

EXAMPLES

Example 1

By using the continuous casting machine shown in FIG. 1 and FIG. 2, that is, using the continuous casting machine where the pair of upper magnetic poles which face each other with the mold long side portion sandwiched therebetween and the pair of lower magnetic poles which face each other with the mold long side portion sandwiched therebetween are provided to the outer side of the mold (a back surface side of the mold), the molten steel discharge holes are positioned between the peak position of the magnetic field of the upper magnetic poles and the peak position of the magnetic field of the lower magnetic poles, approximately 300 tons of aluminum killed extremely low carbon steel was cast by the continuous casting method which controls flow of molten steel using DC magnetic fields applied to the pair of upper magnetic poles and the pair of lower magnetic poles respectively.

An Ar gas was used as an inert gas to be blown off from the immersion nozzle, and a blow-off amount of the Ar gas was adjusted within a range from 5 to 12 NL/min corresponding to opening of a sliding nozzle so as to prevent the occurrence of clogging of the nozzle. The specification of the continuous casting machine and other casting conditions are as follows.

The specification of the continuous casting machine and other casting conditions are as follows.

- molten steel discharge angle of molten steel discharge hole of immersion nozzle α: 15°
- immersing depth of immersion nozzle: 230 mm
- shape of molten steel discharge hole of immersion nozzle: rectangular shape having a size of 70 mm×80 mm
- inner diameter of immersion nozzle: 80 mm
- opening area of each molten steel discharge hole of immersion nozzle: 5600 $mm^2$
- viscosity of mold flux used in examples (1300° C.): 2.5 cp Molten steels which contain chemical components shown in Table 5 were continuously cast under conditions shown in Table 6 to Table 15.

Chemical components of the molten steels were determined by using values measured by analysis of specimens which were sampled from molten steel at the time of finishing refining by an RH vacuum degassing apparatus, and the total oxygen concentration of molten steel was determined by using values measured by chemical analysis of specimens which were sampled from molten steel in a tundish before pouring molten steel into a mold.

A continuously cast slab was formed into a steel plate by hot rolling and cold rolling, and the hot-dip galvannealing treatment was applied to the steel plate. With respect to the galvannealed steel plate, surface defects were continuously measured by an on-line surface defect meter. Surface defects of the hot-dipped galvannealed steel sheet were continuously measured using an online surface defect meter. Out of the surface defects, mold-flux-caused defects, bubble-caused defects, inclusion-caused defects, sliver defects and blister defects are determined by the defective mode (appearance), an SEM analysis, an ICP analysis or the like, and defects after Zn plating was evaluated based on the number of defects per 1 m of a coil length was evaluated in accordance with the following criteria. The result of the evaluation is shown in Table 6 to Table 15 along with the above-mentioned casting conditions.

good: the number of defects being 0.01 or below fair: the number of defects being more than 0.01 and 0.05 or less bad: the number of defects being more than 0.05 and 0.10 or less very bad: the number of defects being more than 0.10

With respect to examples where slabs having a slab width exceeding 1700 mm were cast, data obtained by the simulation carried out based on a result using an actual machine were shown in tables.

TABLE 5

| | Chemical components of molten steel (mass %) | | | | | | | | |
|---|---|---|---|---|---|---|---|---|---|
| No. | [C] | [Si] | [Mn] | [P] | [S] | [Ti] | [○] | X value | Remarks |
| 1 | 0.0024 | 0.01 | 0.62 | 0.042 | 0.012 | 0.045 | 0.0006 | 6270.3 | comparison example |
| 2 | 0.0016 | 0.01 | 0.61 | 0.046 | 0.006 | 0.008 | 0.0002 | 2687.5 | present invention example |
| 3 | 0.0019 | 0.01 | 0.63 | 0.041 | 0.010 | 0.030 | 0.0004 | 4952.5 | present invention example |
| 4 | 0.0019 | 0.01 | 0.15 | 0.037 | 0.007 | 0.024 | 0.0003 | 3558.8 | present invention example |

TABLE 6

| | | Molten steel composition | | Casting condition | | | | | |
|---|---|---|---|---|---|---|---|---|---|
| | | | | Slab | Slab | Casting | Intensity of DC magnetic field | | |
| No. | Classification | Molten steel No. *1 | X value | width (mm) | thickness (mm) | speed (m/s) | Upper magnetic field (T) | Lower magnetic field (T) | Defect after Zn plating |
| 1 | present invention example | 2 | 2688 | 900 | 270 | 0.75 | 0.03 | 0.24 | good |
| 2 | present invention example | 2 | 2688 | 925 | 270 | 1.00 | 0.08 | 0.38 | good |
| 3 | present invention example | 2 | 2688 | 925 | 270 | 2.02 | 0.15 | 0.45 | good |
| 4 | present invention example | 2 | 2688 | 945 | 270 | 1.60 | 0.13 | 0.40 | good |
| 5 | present invention example | 3 | 4953 | 945 | 270 | 1.60 | 0.13 | 0.38 | good |
| 6 | comparison example | 2 | 2688 | 900 | 270 | 1.80 | 0.02 | 0.38 | fair |
| 7 | comparison example | 2 | 2688 | 900 | 270 | 1.70 | 0.17 | 0.38 | fair |
| 8 | comparison example | 2 | 2688 | 900 | 270 | 1.70 | 0.13 | 0.22 | fair |
| 9 | comparison example | 2 | 2688 | 900 | 270 | 1.70 | 0.13 | 0.47 | fair |
| 10 | comparison example | 1 | 6270 | 900 | 270 | 1.70 | 0.13 | 0.38 | bad |
| 11 | comparison example | 1 | 6270 | 900 | 270 | 1.70 | 0.17 | 0.22 | very bad |
| 12 | present invention example | 2 | 2688 | 950 | 260 | 0.75 | 0.03 | 0.24 | good |
| 13 | present invention example | 2 | 2688 | 1000 | 260 | 1.00 | 0.08 | 0.38 | good |

TABLE 6-continued

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 14 | present invention example | 2 | 2688 | 1000 | 260 | 1.70 | 0.12 | 0.38 | good |
| 15 | present invention example | 2 | 2688 | 1000 | 260 | 2.22 | 0.15 | 0.45 | good |
| 16 | present invention example | 2 | 2688 | 1045 | 260 | 1.80 | 0.13 | 0.38 | good |
| 17 | present invention example | 3 | 4953 | 1000 | 260 | 1.70 | 0.12 | 0.38 | good |
| 18 | present invention example | 4 | 3559 | 1000 | 260 | 1.70 | 0.12 | 0.38 | good |
| 19 | comparison example | 2 | 2688 | 1000 | 260 | 1.70 | 0.02 | 0.38 | fair |
| 20 | comparison example | 2 | 2688 | 1000 | 260 | 1.70 | 0.17 | 0.38 | fair |
| 21 | comparison example | 2 | 2688 | 1000 | 260 | 1.70 | 0.12 | 0.22 | fair |
| 22 | comparison example | 2 | 2688 | 1000 | 260 | 1.70 | 0.12 | 0.47 | fair |
| 23 | comparison example | 1 | 6270 | 1000 | 260 | 1.70 | 0.12 | 0.38 | bad |
| 24 | comparison example | 1 | 6270 | 1000 | 260 | 1.70 | 0.17 | 0.22 | very bad |

*1 molten steel No. described in Table 5

TABLE 7

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 25 | present invention example | 2 | 2688 | 1050 | 260 | 0.75 | 0.03 | 0.24 | good |
| 26 | present invention example | 2 | 2688 | 1150 | 260 | 1.00 | 0.06 | 0.38 | good |
| 27 | present invention example | 2 | 2688 | 1250 | 260 | 1.80 | 0.12 | 0.38 | good |
| 28 | present invention example | 2 | 2688 | 1250 | 260 | 2.33 | 0.15 | 0.45 | good |
| 29 | present invention example | 2 | 2688 | 1345 | 260 | 1.80 | 0.12 | 0.38 | good |
| 30 | present invention example | 3 | 4953 | 1250 | 260 | 1.80 | 0.12 | 0.38 | good |
| 31 | present invention example | 4 | 3559 | 1250 | 260 | 1.80 | 0.12 | 0.38 | good |
| 32 | comparison example | 2 | 2688 | 1200 | 260 | 1.80 | 0.02 | 0.38 | fair |
| 33 | comparison example | 2 | 2688 | 1200 | 260 | 1.80 | 0.17 | 0.38 | fair |
| 34 | comparison example | 2 | 2688 | 1200 | 260 | 1.80 | 0.12 | 0.22 | fair |
| 35 | comparison example | 2 | 2688 | 1200 | 260 | 1.80 | 0.12 | 0.47 | fair |
| 36 | comparison example | 1 | 6270 | 1200 | 260 | 1.80 | 0.12 | 0.38 | bad |
| 37 | comparison example | 1 | 6270 | 1200 | 260 | 1.80 | 0.17 | 0.22 | very bad |
| 38 | present invention example | 2 | 2688 | 1350 | 260 | 0.75 | 0.03 | 0.24 | good |
| 39 | present invention example | 2 | 2688 | 1400 | 260 | 1.00 | 0.06 | 0.38 | good |
| 40 | present invention example | 2 | 2688 | 1400 | 260 | 1.80 | 0.12 | 0.38 | good |
| 41 | present invention example | 2 | 2688 | 1400 | 260 | 2.23 | 0.15 | 0.45 | good |
| 42 | present invention example | 2 | 2688 | 1445 | 260 | 1.80 | 0.12 | 0.38 | good |
| 43 | present invention example | 3 | 4953 | 1400 | 260 | 1.80 | 0.12 | 0.38 | good |
| 44 | comparison example | 2 | 2688 | 1400 | 260 | 1.80 | 0.02 | 0.38 | fair |
| 45 | comparison example | 2 | 2688 | 1400 | 260 | 1.80 | 0.17 | 0.38 | fair |
| 46 | comparison example | 2 | 2688 | 1400 | 260 | 1.80 | 0.12 | 0.22 | fair |
| 47 | comparison example | 2 | 2688 | 1400 | 260 | 1.80 | 0.12 | 0.47 | fair |
| 48 | comparison example | 1 | 6270 | 1400 | 260 | 1.80 | 0.12 | 0.38 | bad |
| 49 | comparison example | 1 | 6270 | 1400 | 260 | 1.80 | 0.17 | 0.22 | very bad |

*1 molten steel No. described in Table 5

TABLE 8

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 50 | present invention example | 2 | 2688 | 1450 | 260 | 0.75 | 0.03 | 0.24 | good |
| 51 | present invention example | 2 | 2688 | 1550 | 260 | 1.00 | 0.05 | 0.38 | good |
| 52 | present invention example | 2 | 2688 | 1550 | 260 | 1.60 | 0.11 | 0.38 | good |
| 53 | present invention example | 2 | 2688 | 1550 | 260 | 2.12 | 0.15 | 0.45 | good |
| 54 | present invention example | 2 | 2688 | 1645 | 260 | 1.60 | 0.11 | 0.38 | good |
| 55 | present invention example | 3 | 4953 | 1550 | 260 | 1.60 | 0.11 | 0.38 | good |
| 56 | present invention example | 4 | 3559 | 1550 | 260 | 1.60 | 0.11 | 0.38 | good |
| 57 | comparison example | 2 | 2688 | 1550 | 260 | 1.70 | 0.02 | 0.38 | fair |
| 58 | comparison example | 2 | 2688 | 1550 | 260 | 1.70 | 0.17 | 0.38 | fair |
| 59 | comparison example | 2 | 2688 | 1550 | 260 | 1.70 | 0.11 | 0.22 | fair |

TABLE 8-continued

| No. | Classification | Molten steel composition: Molten steel No. *1 | X value | Casting condition: Slab width (mm) | Slab thickness (mm) | Casting speed (m/s) | Intensity of DC magnetic field: Upper magnetic field (T) | Lower magnetic field (T) | Defect after Zn plating |
|---|---|---|---|---|---|---|---|---|---|
| 60 | comparison example | 2 | 2688 | 1550 | 260 | 1.70 | 0.11 | 0.47 | fair |
| 61 | comparison example | 1 | 6270 | 1550 | 260 | 1.70 | 0.12 | 0.38 | bad |
| 62 | comparison example | 1 | 6270 | 1550 | 260 | 1.70 | 0.17 | 0.22 | very bad |
| 63 | present invention example | 2 | 2688 | 1650 | 250 | 0.75 | 0.03 | 0.24 | good |
| 64 | present invention example | 2 | 2688 | 1700 | 250 | 1.00 | 0.05 | 0.38 | good |
| 65 | present invention example | 2 | 2688 | 1700 | 250 | 1.50 | 0.11 | 0.38 | good |
| 66 | present invention example | 2 | 2688 | 1700 | 250 | 2.02 | 0.15 | 0.45 | good |
| 67 | present invention example | 2 | 2688 | 1745 | 250 | 1.70 | 0.13 | 0.38 | good |
| 68 | present invention example | 3 | 4953 | 1700 | 250 | 1.50 | 0.11 | 0.38 | good |
| 69 | comparison example | 2 | 2688 | 1700 | 250 | 1.60 | 0.02 | 0.38 | fair |
| 70 | comparison example | 2 | 2688 | 1700 | 250 | 1.60 | 0.17 | 0.38 | fair |
| 71 | comparison example | 2 | 2688 | 1700 | 250 | 1.60 | 0.10 | 0.22 | fair |
| 72 | comparison example | 2 | 2688 | 1700 | 250 | 1.60 | 0.10 | 0.47 | fair |
| 73 | comparison example | 1 | 6270 | 1700 | 250 | 1.60 | 0.12 | 0.38 | bad |
| 74 | comparison example | 1 | 6270 | 1700 | 250 | 1.60 | 0.17 | 0.22 | very bad |

*1 molten steel No. described in Table 5

TABLE 9

| No. | Classification | Molten steel composition: Molten steel No. *1 | X value | Casting condition: Slab width (mm) | Slab thickness (mm) | Casting speed (m/s) | Intensity of DC magnetic field: Upper magnetic field (T) | Lower magnetic field (T) | Defect after Zn plating |
|---|---|---|---|---|---|---|---|---|---|
| 75 | present invention example | 2 | 2688 | 1750 | 250 | 0.75 | 0.03 | 0.24 | good |
| 76 | present invention example | 2 | 2688 | 1800 | 250 | 1.00 | 0.04 | 0.38 | good |
| 77 | present invention example | 2 | 2688 | 1800 | 250 | 1.40 | 0.10 | 0.38 | good |
| 78 | present invention example | 2 | 2688 | 1845 | 250 | 1.93 | 0.15 | 0.45 | good |
| 79 | present invention example | 2 | 2688 | 1800 | 250 | 1.45 | 0.11 | 0.38 | good |
| 80 | present invention example | 3 | 4953 | 1800 | 250 | 1.40 | 0.10 | 0.38 | good |
| 81 | comparison example | 2 | 2688 | 1800 | 250 | 1.45 | 0.02 | 0.38 | fair |
| 82 | comparison example | 2 | 2688 | 1800 | 250 | 1.45 | 0.17 | 0.38 | fair |
| 83 | comparison example | 2 | 2688 | 1800 | 250 | 1.45 | 0.11 | 0.22 | fair |
| 84 | comparison example | 2 | 2688 | 1800 | 250 | 1.45 | 0.11 | 0.47 | fair |
| 85 | comparison example | 1 | 6270 | 1800 | 250 | 1.45 | 0.11 | 0.38 | bad |
| 86 | comparison example | 1 | 6270 | 1800 | 250 | 1.45 | 0.17 | 0.22 | very bad |
| 87 | present invention example | 2 | 2688 | 1850 | 250 | 0.75 | 0.03 | 0.24 | good |
| 88 | present invention example | 2 | 2688 | 1900 | 250 | 1.00 | 0.04 | 0.38 | good |
| 89 | present invention example | 2 | 2688 | 1900 | 250 | 1.40 | 0.11 | 0.38 | good |
| 90 | present invention example | 2 | 2688 | 1900 | 250 | 1.82 | 0.15 | 0.45 | good |
| 91 | present invention example | 2 | 2688 | 1945 | 250 | 1.50 | 0.12 | 0.38 | good |
| 92 | present invention example | 3 | 4953 | 1900 | 250 | 1.40 | 0.11 | 0.38 | good |
| 93 | present invention example | 4 | 4953 | 1900 | 250 | 1.40 | 0.11 | 0.38 | good |
| 94 | comparison example | 2 | 2688 | 1900 | 250 | 1.50 | 0.02 | 0.38 | fair |
| 95 | comparison example | 2 | 2688 | 1900 | 250 | 1.50 | 0.17 | 0.38 | fair |
| 96 | comparison example | 2 | 2688 | 1900 | 250 | 1.50 | 0.12 | 0.22 | fair |
| 97 | comparison example | 2 | 2688 | 1900 | 250 | 1.50 | 0.12 | 0.47 | fair |
| 98 | comparison example | 1 | 6270 | 1900 | 250 | 1.50 | 0.12 | 0.38 | bad |
| 99 | comparison example | 1 | 6270 | 1900 | 250 | 1.50 | 0.17 | 0.22 | very bad |

*1 molten steel No. described in Table 5

TABLE 10

| No. | Classification | Molten steel composition: Molten steel No. *1 | X value | Casting condition: Slab width (mm) | Slab thickness (mm) | Casting speed (m/s) | Intensity of DC magnetic field: Upper magnetic field (T) | Lower magnetic field (T) | Defect after Zn plating |
|---|---|---|---|---|---|---|---|---|---|
| 100 | present invention example | 2 | 2688 | 1950 | 260 | 0.75 | 0.03 | 0.24 | good |
| 101 | present invention example | 2 | 2688 | 2050 | 260 | 1.00 | 0.04 | 0.38 | good |
| 102 | present invention example | 2 | 2688 | 2050 | 260 | 1.40 | 0.13 | 0.38 | good |
| 103 | present invention example | 2 | 2688 | 2050 | 260 | 1.72 | 0.15 | 0.45 | good |
| 104 | present invention example | 2 | 2688 | 2145 | 260 | 1.40 | 0.13 | 0.38 | good |
| 105 | present invention example | 3 | 4953 | 2050 | 260 | 1.40 | 0.13 | 0.38 | good |

TABLE 10-continued

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 106 | present invention example | 4 | 3559 | 2050 | 260 | 1.40 | 0.13 | 0.38 | good |
| 107 | comparison example | 2 | 2688 | 2050 | 260 | 1.40 | 0.02 | 0.38 | fair |
| 108 | comparison example | 2 | 2688 | 2050 | 260 | 1.40 | 0.17 | 0.38 | fair |
| 109 | comparison example | 2 | 2688 | 2050 | 260 | 1.40 | 0.13 | 0.22 | fair |
| 110 | comparison example | 2 | 2688 | 2050 | 260 | 1.40 | 0.13 | 0.47 | fair |
| 111 | comparison example | 1 | 6270 | 2050 | 260 | 1.40 | 0.13 | 0.38 | bad |
| 112 | comparison example | 1 | 6270 | 1900 | 260 | 1.40 | 0.17 | 0.22 | very bad |

*1 molten steel No. described in Table 5

TABLE 11

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 113 | present invention example | 2 | 2688 | 900 | 270 | 2.05 | 0.16 | 0.24 | good |
| 114 | present invention example | 2 | 2688 | 925 | 270 | 2.55 | 0.18 | 0.38 | good |
| 115 | present invention example | 2 | 2688 | 925 | 270 | 2.80 | 0.19 | 0.38 | good |
| 116 | present invention example | 2 | 2688 | 925 | 270 | 3.04 | 0.30 | 0.45 | good |
| 117 | present invention example | 2 | 2688 | 945 | 270 | 2.55 | 0.18 | 0.38 | good |
| 118 | present invention example | 3 | 4953 | 925 | 270 | 2.55 | 0.18 | 0.38 | good |
| 119 | present invention example | 4 | 3559 | 925 | 270 | 2.55 | 0.18 | 0.38 | good |
| 120 | comparison example | 2 | 2688 | 900 | 270 | 2.55 | 0.15 | 0.38 | fair |
| 121 | comparison example | 2 | 2688 | 900 | 270 | 2.55 | 0.32 | 0.38 | fair |
| 122 | comparison example | 2 | 2688 | 900 | 270 | 2.55 | 0.18 | 0.23 | fair |
| 123 | comparison example | 2 | 2688 | 900 | 270 | 2.55 | 0.18 | 0.46 | fair |
| 124 | comparison example | 1 | 6270 | 900 | 270 | 2.55 | 0.18 | 0.38 | bad |
| 125 | comparison example | 1 | 6270 | 900 | 270 | 2.55 | 0.32 | 0.22 | very bad |
| 126 | present invention example | 2 | 2688 | 950 | 260 | 2.25 | 0.16 | 0.24 | good |
| 127 | present invention example | 2 | 2688 | 1000 | 260 | 2.75 | 0.18 | 0.38 | good |
| 128 | present invention example | 2 | 2688 | 1000 | 260 | 2.90 | 0.18 | 0.38 | good |
| 129 | present invention example | 2 | 2688 | 1000 | 260 | 3.04 | 0.30 | 0.45 | good |
| 130 | present invention example | 2 | 2688 | 1045 | 260 | 2.75 | 0.18 | 0.38 | good |
| 131 | present invention example | 3 | 4953 | 1000 | 260 | 2.75 | 0.18 | 0.38 | good |
| 132 | comparison example | 2 | 2688 | 1000 | 260 | 2.75 | 0.15 | 0.38 | fair |
| 133 | comparison example | 2 | 2688 | 1000 | 260 | 2.75 | 0.32 | 0.38 | fair |
| 134 | comparison example | 2 | 2688 | 1000 | 260 | 2.75 | 0.13 | 0.23 | fair |
| 135 | comparison example | 2 | 2688 | 1000 | 260 | 2.75 | 0.18 | 0.46 | fair |
| 136 | comparison example | 1 | 6270 | 1000 | 260 | 2.75 | 0.18 | 0.38 | bad |
| 137 | comparison example | 1 | 6270 | 1000 | 260 | 2.75 | 0.32 | 0.22 | very bad |

*1 molten steel No. described in Table 5

TABLE 12

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 138 | present invention example | 2 | 2688 | 1050 | 260 | 2.35 | 0.16 | 0.24 | good |
| 139 | present invention example | 2 | 2688 | 1150 | 260 | 2.70 | 0.17 | 0.38 | good |
| 140 | present invention example | 2 | 2688 | 1250 | 260 | 2.90 | 0.18 | 0.38 | good |
| 141 | present invention example | 2 | 2688 | 1250 | 260 | 3.04 | 0.30 | 0.45 | good |
| 142 | present invention example | 2 | 2688 | 1345 | 260 | 2.70 | 0.17 | 0.38 | good |
| 143 | present invention example | 3 | 4953 | 1250 | 260 | 2.70 | 0.17 | 0.38 | good |
| 144 | comparison example | 2 | 2688 | 1200 | 260 | 2.70 | 0.15 | 0.38 | fair |
| 145 | comparison example | 2 | 2688 | 1200 | 260 | 2.70 | 0.32 | 0.38 | fair |
| 146 | comparison example | 2 | 2688 | 1200 | 260 | 2.70 | 0.17 | 0.23 | fair |
| 147 | comparison example | 2 | 2688 | 1200 | 260 | 2.70 | 0.17 | 0.46 | fair |
| 148 | comparison example | 1 | 6270 | 1200 | 260 | 2.70 | 0.17 | 0.38 | bad |
| 149 | comparison example | 1 | 6270 | 1200 | 260 | 2.70 | 0.32 | 0.22 | very bad |
| 150 | present invention example | 2 | 2688 | 1350 | 260 | 2.25 | 0.16 | 0.24 | good |
| 151 | present invention example | 2 | 2688 | 1400 | 260 | 2.80 | 0.18 | 0.38 | good |

TABLE 12-continued

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 152 | present invention example | 2 | 2688 | 1400 | 260 | 2.95 | 0.19 | 0.38 | good |
| 153 | present invention example | 2 | 2688 | 1400 | 260 | 3.04 | 0.30 | 0.45 | good |
| 154 | present invention example | 2 | 2688 | 1445 | 260 | 2.80 | 0.18 | 0.38 | good |
| 155 | present invention example | 3 | 4953 | 1400 | 260 | 2.80 | 0.18 | 0.38 | good |
| 156 | present invention example | 4 | 3559 | 1400 | 260 | 2.80 | 0.18 | 0.38 | good |
| 157 | comparison example | 2 | 2688 | 1400 | 260 | 2.80 | 0.15 | 0.38 | fair |
| 158 | comparison example | 2 | 2688 | 1400 | 260 | 2.80 | 0.32 | 0.38 | fair |
| 159 | comparison example | 2 | 2688 | 1400 | 260 | 2.80 | 0.18 | 0.23 | fair |
| 160 | comparison example | 2 | 2688 | 1400 | 260 | 2.80 | 0.18 | 0.46 | fair |
| 161 | comparison example | 1 | 6270 | 1400 | 260 | 2.80 | 0.18 | 0.38 | bad |
| 162 | comparison example | 1 | 6270 | 1400 | 260 | 2.80 | 0.32 | 0.22 | very bad |

*1 molten steel No. described in Table 5

TABLE 13

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 163 | present invention example | 2 | 2688 | 1450 | 260 | 2.15 | 0.16 | 0.24 | good |
| 164 | present invention example | 2 | 2688 | 1500 | 260 | 2.75 | 0.18 | 0.38 | good |
| 165 | present invention example | 2 | 2688 | 1500 | 260 | 2.95 | 0.19 | 0.38 | good |
| 166 | present invention example | 2 | 2688 | 1500 | 260 | 3.04 | 0.30 | 0.45 | good |
| 167 | present invention example | 2 | 2688 | 1545 | 260 | 2.75 | 0.18 | 0.38 | good |
| 168 | present invention example | 3 | 4953 | 1500 | 260 | 2.75 | 0.18 | 0.38 | good |
| 169 | present invention example | 4 | 3559 | 1500 | 260 | 2.75 | 0.18 | 0.38 | good |
| 170 | comparison example | 2 | 2688 | 1500 | 260 | 2.75 | 0.15 | 0.38 | fair |
| 171 | comparison example | 2 | 2688 | 1500 | 260 | 2.75 | 0.32 | 0.38 | fair |
| 172 | comparison example | 2 | 2688 | 1500 | 260 | 2.75 | 0.18 | 0.23 | fair |
| 173 | comparison example | 2 | 2688 | 1500 | 260 | 2.75 | 0.18 | 0.46 | fair |
| 174 | comparison example | 1 | 6270 | 1500 | 260 | 2.75 | 0.18 | 0.38 | bad |
| 175 | comparison example | 1 | 6270 | 1500 | 260 | 2.75 | 0.32 | 0.22 | very bad |
| 176 | present invention example | 2 | 2688 | 1550 | 260 | 2.15 | 0.16 | 0.24 | good |
| 177 | present invention example | 2 | 2688 | 1600 | 260 | 2.45 | 0.17 | 0.38 | good |
| 178 | present invention example | 2 | 2688 | 1600 | 260 | 2.65 | 0.19 | 0.38 | good |
| 179 | present invention example | 2 | 2688 | 1600 | 260 | 2.84 | 0.30 | 0.45 | good |
| 180 | present invention example | 2 | 2688 | 1645 | 260 | 2.45 | 0.17 | 0.38 | good |
| 181 | present invention example | 3 | 4953 | 1600 | 260 | 2.45 | 0.17 | 0.38 | good |
| 182 | comparison example | 2 | 2688 | 1600 | 260 | 2.45 | 0.15 | 0.38 | fair |
| 183 | comparison example | 2 | 2688 | 1600 | 260 | 2.45 | 0.32 | 0.38 | fair |
| 184 | comparison example | 2 | 2688 | 1600 | 260 | 2.45 | 0.17 | 0.23 | fair |
| 185 | comparison example | 2 | 2688 | 1600 | 260 | 2.45 | 0.17 | 0.46 | fair |
| 186 | comparison example | 1 | 6270 | 1600 | 260 | 2.45 | 0.17 | 0.38 | bad |
| 187 | comparison example | 1 | 6270 | 1600 | 260 | 2.45 | 0.32 | 0.22 | very bad |

*1 molten steel No. described in Table 5

TABLE 14

| No. | Classification | Molten steel composition: Molten steel No. *1 | Molten steel composition: X value | Casting condition: Slab width (mm) | Casting condition: Slab thickness (mm) | Casting condition: Casting speed (m/s) | Casting condition: Intensity of DC magnetic field: Upper magnetic field (T) | Casting condition: Intensity of DC magnetic field: Lower magnetic field (T) | Defect after Zn plating |
|---|---|---|---|---|---|---|---|---|---|
| 188 | present invention example | 2 | 2688 | 1650 | 250 | 2.05 | 0.16 | 0.24 | good |
| 189 | present invention example | 2 | 2688 | 1700 | 250 | 2.35 | 0.17 | 0.38 | good |
| 190 | present invention example | 2 | 2688 | 1700 | 250 | 2.55 | 0.18 | 0.38 | good |
| 191 | present invention example | 2 | 2688 | 1700 | 250 | 2.64 | 0.30 | 0.45 | good |
| 192 | present invention example | 2 | 2688 | 1745 | 250 | 2.35 | 0.17 | 0.38 | good |
| 193 | present invention example | 3 | 4953 | 1700 | 250 | 2.35 | 0.17 | 0.38 | good |
| 194 | comparison example | 2 | 2688 | 1700 | 250 | 2.35 | 0.15 | 0.38 | fair |
| 195 | comparison example | 2 | 2688 | 1700 | 250 | 2.35 | 0.32 | 0.38 | fair |
| 196 | comparison example | 2 | 2688 | 1700 | 250 | 2.35 | 0.17 | 0.23 | fair |
| 197 | comparison example | 2 | 2688 | 1700 | 250 | 2.35 | 0.17 | 0.46 | fair |

TABLE 14-continued

| No. | Classification | Molten steel composition: Molten steel No. *1 | X value | Casting condition: Slab width (mm) | Slab thickness (mm) | Casting speed (m/s) | Intensity of DC magnetic field: Upper magnetic field (T) | Lower magnetic field (T) | Defect after Zn plating |
|---|---|---|---|---|---|---|---|---|---|
| 198 | comparison example | 1 | 6270 | 1700 | 250 | 2.35 | 0.17 | 0.38 | bad |
| 199 | comparison example | 1 | 6270 | 1700 | 250 | 2.35 | 0.32 | 0.22 | very bad |
| 200 | present invention example | 2 | 2688 | 1750 | 250 | 1.95 | 0.16 | 0.24 | good |
| 201 | present invention example | 2 | 2688 | 1800 | 250 | 2.25 | 0.17 | 0.38 | good |
| 202 | present invention example | 2 | 2688 | 1800 | 250 | 2.45 | 0.18 | 0.38 | good |
| 203 | present invention example | 2 | 2688 | 1845 | 250 | 2.54 | 0.30 | 0.45 | good |
| 204 | present invention example | 2 | 2688 | 1800 | 250 | 2.25 | 0.17 | 0.38 | good |
| 205 | present invention example | 3 | 4953 | 1800 | 250 | 2.25 | 0.17 | 0.38 | good |
| 206 | present invention example | 4 | 3559 | 1800 | 250 | 2.25 | 0.17 | 0.38 | good |
| 207 | comparison example | 2 | 2688 | 1800 | 250 | 2.25 | 0.15 | 0.38 | fair |
| 208 | comparison example | 2 | 2688 | 1800 | 250 | 2.25 | 0.32 | 0.38 | fair |
| 209 | comparison example | 2 | 2688 | 1800 | 250 | 2.25 | 0.17 | 0.23 | fair |
| 210 | comparison example | 2 | 2688 | 1800 | 250 | 2.25 | 0.17 | 0.46 | fair |
| 211 | comparison example | 1 | 6270 | 1800 | 250 | 2.25 | 0.18 | 0.38 | bad |
| 212 | comparison example | 1 | 6270 | 1800 | 250 | 2.25 | 0.32 | 0.22 | very bad |

*1 molten steel No. described in Table 5

TABLE 15

| No. | Classification | Molten steel composition: Molten steel No. *1 | X value | Casting condition: Slab width (mm) | Slab thickness (mm) | Casting speed (m/s) | Intensity of DC magnetic field: Upper magnetic field (T) | Lower magnetic field (T) | Defect after Zn plating |
|---|---|---|---|---|---|---|---|---|---|
| 213 | present invention example | 2 | 2688 | 1850 | 250 | 1.85 | 0.16 | 0.24 | good |
| 214 | present invention example | 2 | 2688 | 1900 | 250 | 2.15 | 0.17 | 0.38 | good |
| 215 | present invention example | 2 | 2688 | 1900 | 250 | 2.35 | 0.18 | 0.38 | good |
| 216 | present invention example | 2 | 2688 | 1900 | 250 | 2.54 | 0.30 | 0.45 | good |
| 217 | present invention example | 2 | 2688 | 1945 | 250 | 2.15 | 0.17 | 0.38 | good |
| 218 | present invention example | 3 | 4953 | 1900 | 250 | 2.15 | 0.17 | 0.38 | good |
| 219 | present invention example | 4 | 3559 | 1900 | 250 | 2.15 | 0.17 | 0.38 | good |
| 220 | comparison example | 2 | 2688 | 1900 | 250 | 2.15 | 0.15 | 0.38 | fair |
| 221 | comparison example | 2 | 2688 | 1900 | 250 | 2.15 | 0.32 | 0.38 | fair |
| 222 | comparison example | 2 | 2688 | 1900 | 250 | 2.15 | 0.17 | 0.23 | fair |
| 223 | comparison example | 2 | 2688 | 1900 | 250 | 2.15 | 0.17 | 0.46 | fair |
| 224 | comparison example | 1 | 6270 | 1900 | 250 | 2.15 | 0.17 | 0.38 | bad |
| 225 | comparison example | 1 | 6270 | 1900 | 250 | 2.15 | 0.32 | 0.22 | very bad |
| 226 | present invention example | 2 | 2688 | 1950 | 260 | 1.75 | 0.16 | 0.24 | good |
| 227 | present invention example | 2 | 2688 | 2050 | 260 | 2.00 | 0.17 | 0.38 | good |
| 228 | present invention example | 2 | 2688 | 2050 | 260 | 2.35 | 0.18 | 0.38 | good |
| 229 | present invention example | 2 | 2688 | 2050 | 260 | 2.54 | 0.30 | 0.45 | good |
| 230 | present invention example | 2 | 2688 | 2145 | 260 | 2.00 | 0.17 | 0.38 | good |
| 231 | present invention example | 3 | 4953 | 2050 | 260 | 2.00 | 0.17 | 0.38 | good |
| 232 | comparison example | 2 | 2688 | 2050 | 260 | 2.00 | 0.15 | 0.38 | fair |
| 233 | comparison example | 2 | 2688 | 2050 | 260 | 2.00 | 0.32 | 0.38 | fair |
| 234 | comparison example | 2 | 2688 | 2050 | 260 | 2.00 | 0.17 | 0.23 | fair |
| 235 | comparison example | 2 | 2688 | 2050 | 260 | 2.00 | 0.17 | 0.46 | fair |
| 236 | comparison example | 1 | 6270 | 2050 | 260 | 2.00 | 0.17 | 0.38 | bad |
| 237 | comparison example | 1 | 6270 | 2050 | 260 | 2.00 | 0.32 | 0.22 | very bad |

*1 molten steel No. described in Table 5

Example 2

Using the substantially same facility and the method as the example 1 (continuous casting machine, the blowing condition of an Ar gas, a mold flux condition and the like), molten steel containing chemical components of the example No. 2 shown in Table 5 was continuously cast under the conditions shown in Table 16. The continuously cast slab was formed into a steel sheet by hot rolling, pickling and cold rolling, and the galvannealing treatment was applied to the steel sheet. Out of examples shown in Table 16, in the examples No. 1 to No. 3 and the examples No. 9 to No. 11, after finishing the pickling, steel sheets were left at a room temperature for a time t shown in the same Table and, thereafter, the examples are subject to cold rolling. On the other hand, in other examples, using a PPCM line where an electric-heater-type heating furnace is arranged between a pickling facility and a cold rolling facility, after finishing pickling, the steel sheet was heated to a steel sheet-surface temperature T in an Ar gas atmosphere using the heating furnace and, thereafter, the steel sheet was subject to cold rolling.

Surface defects of the manufactured hot-dipped galvannealed steel sheet were continuously measured using an online surface defect meter. Out of the surface defects, sliver defects (mold-flux-caused defects, bubble-caused defects, inclusion-caused defects) and blister defects were determined by a defective mode (appearance), an SEM analysis, an ICP analysis or the like, and defects after Zn plating was evaluated based on the number of defects per 1 m of a coil length was evaluated in accordance with the following criteria. In the criteria for defects after Zn plating, the first symbol (good) indicates the number of sliver defects (in accordance with the same evaluation criteria as the example 1), and the second symbol (very good, good, fair, bad) indicates the number of blister defects. The first symbol "good" indicates that the number of defects is 0.01 pieces or less, and the number of defects which the second symbol indicates is as follows.

very good: the number of defects being $0.0200\times10^{-2}$ or less good: the number of defects being more than $0.0200\times10^{-2}$ and $0.0250\times10^{-2}$ or less fair: the number of defects being more than $0.0250\times10^{-2}$ and $0.0350\times10^{-2}$ or less bad: the number of defects being more than $0.0350\times10^{-2}$ All examples No. 1 to No. 16 satisfy the preferred continuous casting conditions of the present invention. On the other hand, although the examples No. 2, No. 3, No. 5, No. 7, No. 8, No. 10, No. 11, No. 13, No. 15, and No. 16 satisfy the formula (1a) which is the preferred manufacturing condition of steel sheet of the present invention, the examples No. 1, No. 4, No. 6, No. 9, No. 12, and No. 14 do not satisfy the formula (1a). According to these examples, it is understood that, the examples which satisfy the formula (1a) which is a preferred manufacturing condition of the steel sheet of the present invention, the occurrence of the blister defects can be more effectively suppressed.

Further, it is also understood that the smaller a value of $Ho\cdot\exp[-0.002\times(T+t/100)]$ for the Hc value, the larger an effect of preventing the occurrence of the blister defects

TABLE 16

| | | Molten steel composition | | Casting condition | | | | |
|---|---|---|---|---|---|---|---|---|
| | | | | | | | Intensity of DC magnetic field | |
| No. | Determination *7 | Molten steel No. *1 | X value | Slab width (mm) | Slab thickness (mm) | Casting speed (m/s) | Upper magnetic field (T) | Lower magnetic field (T) |
| 1 | not satisfied | 2 | 2688 | 1550 | 260 | 1.70 | 0.11 | 0.38 |
| 2 | satisfied | 2 | 2688 | 1550 | 260 | 1.70 | 0.11 | 0.38 |
| 3 | satisfied | 2 | 2688 | 1550 | 260 | 1.70 | 0.11 | 0.38 |
| 4 | not satisfied | 2 | 2688 | 1550 | 260 | 1.70 | 0.11 | 0.38 |
| 5 | satisfied | 2 | 2688 | 1550 | 260 | 1 70 | 0.11 | 0.38 |
| 6 | not satisfied | 2 | 2688 | 1550 | 260 | 1.70 | 0.11 | 0.38 |
| 7 | satisfied | 2 | 2688 | 1550 | 260 | 1.70 | 0.11 | 0.38 |
| 8 | satisfied | 2 | 2688 | 1550 | 260 | 1.70 | 0.11 | 0.38 |
| 9 | not satisfied | 2 | 2688 | 1550 | 260 | 2.15 | 0.17 | 0.38 |
| 10 | satisfied | 2 | 2688 | 1600 | 260 | 2.45 | 0.17 | 0.38 |
| 11 | satisfied | 2 | 2688 | 1600 | 260 | 2.65 | 0.17 | 0.38 |
| 12 | not satisfied | 2 | 2688 | 1600 | 260 | 2.84 | 0.17 | 0.38 |
| 13 | satisfied | 2 | 2688 | 1645 | 260 | 2.45 | 0.17 | 0.38 |
| 14 | not satisfied | 2 | 2688 | 1600 | 260 | 2.45 | 0.17 | 0.38 |
| 15 | satisfied | 2 | 2688 | 1600 | 260 | 2.45 | 0.17 | 0.38 |
| 16 | satisfied | 2 | 2688 | 1600 | 260 | 2.45 | 0.17 | 0.38 |

| No. | Reduction amount by pickling ($g/m^2$) | $H_0$ *2 | Finish thickness after cold rolling (mm) | $H_C$ *3 | t *4 | $T_0$ *5 | T *6 | $H_0\cdot\exp[-0.002\times(T+t/100)]$ | Defect after Zn plating |
|---|---|---|---|---|---|---|---|---|---|
| 1 | 52 | 0.100 | 1.50 | 0.028 | 5480 | 297 | 297 | 0.049 | good/bad |
| 2 | 52 | 0.100 | 1.20 | 0.028 | 36300 | 299 | 299 | 0.027 | good/fair |
| 3 | 58 | 0.111 | 1.50 | 0.027 | 59000 | 295 | 295 | 0.019 | good/very good |
| 4 | 58 | 0.111 | 1.50 | 0.027 | 120 | 303 | 388 | 0.051 | good/bad |
| 5 | 58 | 0.111 | 1.20 | 0.028 | 124 | 301 | 710 | 0.027 | good/fair |
| 6 | 52 | 0.100 | 1.20 | 0.028 | 1480 | 296 | 420 | 0.042 | good/bad |
| 7 | 52 | 0.100 | 1.50 | 0.031 | 1050 | 300 | 602 | 0.029 | good/good |
| 8 | 52 | 0.100 | 1.50 | 0.031 | 18000 | 299 | 608 | 0.021 | good/very good |
| 9 | 58 | 0.111 | 1.20 | 0.028 | 6200 | 301 | 301 | 0.054 | good/bad |
| 10 | 52 | 0.100 | 1.20 | 0.028 | 38800 | 306 | 306 | 0.024 | good/good |
| 11 | 58 | 0.111 | 1.50 | 0.028 | 68100 | 299 | 299 | 0.016 | good/very good |
| 12 | 52 | 0.100 | 1.60 | 0.031 | 120 | 298 | 376 | 0.047 | good/bad |
| 13 | 58 | 0.111 | 1.50 | 0.031 | 120 | 298 | 694 | 0.028 | good/good |
| 14 | 52 | 0.100 | 1.20 | 0.028 | 1260 | 299 | 420 | 0.042 | good/bad |
| 15 | 52 | 0.100 | 1.60 | 0.031 | 2160 | 300 | 615 | 0.028 | good/good |
| 16 | 58 | 0.111 | 1.50 | 0.031 | 18620 | 304 | 621 | 0.022 | good/very good |

*1 molten steel No. described in Table 5

*2 $H_0$: hydrogen concentration in steel plate immediately after pickling is finished (mass %)

*3 $H_C$: critical hydrogen concentration (mass ppm) in steel sheet immediately before cold rolling at which surface quality defects occur by blister, the critical hydrogen concentration being determined based on cold rolling conditions

*4 t: time until cold rolling starts after pickling is finished (sec)

*5 $T_0$: surface temperature of steel plate immediately after pickling is finished (K)

*6 T: maximum surface temperature (K) of steel sheet after pickling is finished and before cold rolling starts

*7 determination on whether or not steel sheet satisfies conditions of "manufacturing method of steel sheet" of present invention becomes. Particularly, when the difference between the Hc value and the value of Ho·exp[−0.002×(T+t/100)] is 0.005 or more, the number of defects after Zn plating is extremely small and hence, such setting is preferable. After pickling, a hot-rolled steel sheet before cold rolling may be heated to a temperature higher than a steel sheet temperature immediately after pickling. The value of Ho·exp[−0.002×(T+t/100)] can be decreased due to increase in T and hence, such heating is effective for the prevention of the blister defects.

According to the continuous casting method of the present invention, it is possible to acquire the slab having high quality not only with the small number of defects caused by non-metallic inclusions and a mold flux which have been considered as problems conventionally but also with the small number of defects caused by minute bubbles and minute non-metallic inclusions. Further, particularly, by optimizing the nozzle immersing depth and the nozzle inner diameter of the immersion nozzle and an opening area of a molten steel discharge hole, it is possible to produce a slab having higher quality. Still further, according to the method for manufacturing a steel sheet, a steel sheet having high quality with extremely small number of blisters can be manufactured.

REFERENCE SIGNS LIST

1: mold
2: immersion nozzle
3*a*, 3*b*: upper magnetic pole
4*a*, 4*b*: lower magnetic pole
5: solidified shell
6: meniscus
10: mold long-side portion
11: mold short-side portion
21: bottom portion
20: molten steel discharge hole

The invention claimed is:

1. A continuous casting method for steel in which extremely low carbon steel containing 0.003 mass % or less of C is continuously cast using a continuous casting machine where a pair of upper magnetic poles which is arranged so that the upper magnetic poles face each other with a mold long-side portion sandwiched therebetween and a pair of lower magnetic poles which is arranged so that the lower magnetic poles face each other with the mold long-side portion sandwiched therebetween are provided to an outer side of a mold, an immersion nozzle with a molten steel discharge angle of a molten steel discharge hole directing downward from a horizontal direction is set to 10° or more and less than 30° is provided, and the molten steel discharge hole is positioned between a peak position of a magnetic field of the upper magnetic poles and a peak position of a magnetic field of the lower magnetic poles, while a molten steel flow is braked by a DC magnetic field applied to the pair of upper magnetic poles and the pair of lower magnetic poles, wherein molten steel containing chemical components where an X value defined by a following formula (I) satisfies X≤5000 is continuously cast at a casting speed of 0.75 m/min or more and in accordance with following conditions (X),(Y):

$$X=24989\times[\%\ Ti]+386147\times[\%\ S]+853354\times[\%\ O] \quad (1)$$

Here, [% Ti]: Ti content in molten steel (mass %), [% S]: S content in molten steel (mass %), and [% O]: O content in molten steel (mass %), Condition (X): When a slab width of a slab to be cast and a casting speed fall within following ranges (a) to (i), intensity of a DC magnetic field applied to the upper magnetic poles is set to 0.03 to 0.15 T and intensity of a DC magnetic field applied to the lower magnetic poles is set to 0.24 to 0.45 T, (a) the slab width being less than 950 mm and the casting speed being less than 2.05 m/min,
(b) the slab width being 950 mm or more and less than 1050 mm and the casting speed being less than 2.25 m/min,
(c) the slab width being 1050 mm or more and less than 1350 mm and the casting speed being less than 2.35 m/min,
(d) the slab width being 1350 mm or more and less than 1450 mm and the casting speed being less than 2.25 m/min,
(e) the slab width being 1450 mm or more and less than 1650 mm and the casting speed being less than 2.15 m/min,
(f) the slab width being 1650 mm or more and less than 1750 mm and the casting speed being less than 2.05 m/min,
(g) the slab width being 1750 mm or more and less than 1850 mm and the casting speed being less than 1.95 m/min,
(h) the slab width being 1850 mm or more and less than 1950 mm and the casting speed being less than 1.85 m/min, and
(i) the slab width being 1950 mm or more and less than 2150 mm and the casting speed being less than 1.75 m/min, Condition (Y): when a slab width of a slab to be cast and a casting speed fall within following ranges (j) to (s), intensity of a DC magnetic field applied to the upper magnetic poles is set to more than 0.15 to 0.30 T and intensity of a DC magnetic field applied to the lower magnetic poles is set to 0.24 to 0.45 T, (j) the slab width being less than 950 mm and the casting speed being 2.05 m/min or more and 3.05 m/min or less,
(k) the slab width being 950 mm or more and less than 1050 mm and the casting speed being 2.25 m/min or more and 3.05 m/min or less,
(l) the slab width being 1050 mm or more and less than 1350 mm and the casting speed being 2.35 m/min or more and 3.05 m/min or less,
(m) the slab width being 1350 mm or more and less than 1450 mm and the casting speed being 2.25 m/min or more and 3.05 m/min or less,
(n) the slab width being 1450 mm or more and less than 1550 mm and the casting speed being 2.15 m/min or more and 3.05 m/min or less,
(o) the slab width being 1550 mm or more and less than 1650 mm and the casting speed being 2.15 m/min or more and 2.85 m/min or less,
(p) the slab width being 1650 mm or more and less than 1750 mm and the casting speed being 2.05 m/min or more and 2.65 m/min or less,
(q) the slab width being 1750 mm or more and less than 1850 mm and the casting speed being 1.95 m/min or more and 2.55 m/min or less,
(r) the slab width being 1850 mm or more and less than 1950 mm and the casting speed being 1.85 m/min or more and 2.55 m/min or less, and
(s) the slab width being 1950 mm or more and less than 2150 mm and the casting speed being 1.75 m/min or more and 2.55 m/min or less.

2. A method for manufacturing a steel sheet where a hot-rolled steel sheet is obtained by hot rolling a slab produced by casting using the continuous casting method according to claim 1, the hot-rolled steel sheet is subject to pickling and, thereafter, in applying cold rolling to the hot-rolled steel sheet, time t and/or a maximum surface temperature T of the steel sheet is controlled so as to satisfy a following formula (1a), $$Hc/Ho > exp\{-0.002\times(T+t/100)\} \quad (1a)$$

Here, Ho: hydrogen concentration (mass ppm) in steel sheet immediately after pickling is finished Hc: critical hydrogen concentration (mass ppm) in steel sheet immediately before cold rolling at which surface quality defects occur by blister, the critical hydrogen concentration being determined based on cold rolling conditions t: time until cold rolling starts after pickling is finished (sec)

T: maximum surface temperature T (K) of steel sheet after pickling is finished and before cold rolling starts (the steel sheet surface temperature also includes steel sheet surface temperature when the steel sheet is heated after pickling is finished and before cold rolling).

3. The continuous casting method for steel according to claim 1, wherein a nozzle immersing depth of the immersion nozzle is set to a value which falls within a range from 230 to 290 mm.

4. The continuous casting method for steel according to claim 1, wherein a nozzle inner diameter (the nozzle inner diameter at a position where the molten steel discharge hole is formed) of the immersion nozzle is set to a value which falls within a range from 70 to 90 mm.

5. The continuous casting method for steel according to claim 1, wherein an opening area of said each molten steel discharge hole of the immersion nozzle is set to a value which falls within a range from 3600 to 8100 $mm^2$.

6. The continuous casting method for steel according to claim 1, wherein a nozzle immersing depth of the immersion nozzle is set to a value which falls within a range from 230 to 290 mm, a nozzle inner diameter (the nozzle inner diameter at a position where the molten steel discharge hole is formed) of the immersion nozzle is set to a value which falls within a range from 70 to 90 mm, and an opening area of said each molten steel discharge hole of the immersion nozzle is set to a value which falls within a range from 3600 to 8100 $mm^2$.

7. The continuous casting method for steel according to claim 1, wherein, with respect to the molten steel in the mold, turbulence energy of molten steel on top surface is set to a value which falls within a range from 0.0010 to 0.0015 $m^2/s^2$, flow velocity of molten steel on top surface is set to 0.30 m/s or less, and flow velocity of molten steel at molten steel-solidified shell interface is set to a value which falls within a range from 0.08 to 0.15 m/s.

8. The continuous casting method for steel according to claim 7, wherein, with respect to the molten steel in the mold, the flow velocity of molten steel on top surface is set to a value which falls within a range from 0.05 to 0.30 m/s.

9. The continuous casting method for steel according to claim 7, wherein, with respect to the molten steel in the mold, a ratio A/B between flow velocity of molten steel at molten steel-solidified shell interface A and flow velocity of molten steel on top surface B is set to a value which falls within a range from 1.0 to 2.0.

10. The continuous casting method for steel according to claim 1, wherein, with respect to the molten steel in the mold, turbulence energy of molten steel on top surface is set to a value which falls within a range from 0.0010 to 0.0015 $m^2/s^2$, flow velocity of molten steel on top surface is set to 0.05 to 0.30 m/s or less, flow velocity of molten steel at molten steel-solidified shell interface is set to a value which falls within a range from 0.08 to 0.15 m/s, and a ratio A/B between flow velocity of molten steel at molten steel-solidified shell interface A and flow velocity of molten steel on top surface B is set to a value which falls within a range from 1.0 to 2.0.

11. The continuous casting method for steel according to claim 7, wherein, with respect to the molten steel in the mold, concentration of bubbles at molten steel-solidified shell interface is set to 0.008 $kg/m^3$ or less.

12. The continuous casting method for steel according to claim 11, wherein a slab thickness of a slab to be cast is set to a value which falls within a range from 220 to 300 mm, and a blow-off amount of an inert gas from an inner wall surface of the immersion nozzle is set to a value which falls within a range from 3 to 25 NL/min.

13. The method for manufacturing a steel sheet according to claim 2, wherein a nozzle immersing depth of an immersion nozzle is set to a value which falls within a range from 230 to 290 mm.

14. The method for manufacturing a steel sheet according to claim 2, wherein a nozzle inner diameter (the nozzle inner diameter at a position where the molten steel discharge hole is formed) of the immersion nozzle is set to a value which falls within a range from 70 to 90 mm.

15. The method for manufacturing a steel sheet according to claim 2, wherein an opening area of said each molten steel discharge hole of the immersion nozzle is set to a value which falls within a range from 3600 to 8100 $mm^2$.

16. The method for manufacturing a steel sheet according to claim 2, wherein a nozzle immersing depth of an immersion nozzle is set to a value which falls within a range from 230 to 290 mm, a nozzle inner diameter (the nozzle inner diameter at a position where the molten steel discharge hole is formed) of the immersion nozzle is set to a value which falls within a range from 70 to 90 mm, and an opening area of said each molten steel discharge hole of the immersion nozzle is set to a value which falls within a range from 3600 to 8100 $mm^2$.

17. The method for manufacturing a steel sheet according to claim 2, wherein, with respect to the molten steel in the mold, turbulence energy of molten steel on top surface is set to a value which falls within a range from 0.0010 to 0.0015 $m^2/s^2$, flow velocity of molten steel on top surface is set to 0.30 m/s or less, and flow velocity of molten steel at molten steel-solidified shell interface is set to a value which falls within a range from 0.08 to 0.15 m/s.

18. The method for manufacturing a steel sheet according to claim 17, wherein, with respect to the molten steel in the mold, the flow velocity of molten steel on top surface is set to a value which falls within a range from 0.05 to 0.30 m/s.

19. The method for manufacturing a steel sheet according to claim 17, wherein, with respect to the molten steel in the mold, a ratio A/B between flow velocity of molten steel at molten steel-solidified shell interface A and flow velocity of molten steel on top surface B is set to a value which falls within a range from 1.0 to 2.0.

20. The method for manufacturing a steel sheet according to claim 2, wherein, with respect to the molten steel in the mold, turbulence energy of molten steel on top surface is set to a value which falls within a range from 0.0010 to 0.0015 $m^2/s^2$, flow velocity of molten steel on top surface is set to 0.05 to 0.30 m/s or less, flow velocity of molten steel at molten steel-solidified shell interface is set to a value which falls within a range from 0.08 to 0.15 m/s, and a ratio A/B between flow velocity of molten steel at molten steel-solidified shell interface A and flow velocity of molten steel on top surface B is set to a value which falls within a range from 1.0 to 2.0.

21. The method for manufacturing a steel sheet according to claim 17, wherein, with respect to the molten steel in the mold, concentration of bubbles at molten steel-solidified shell interface is set to 0.008 $kg/m^3$ or less.

22. The continuous casting method for steel according to claim 21, wherein a slab thickness of a slab to be cast is set to a value which falls within a range from 220 to 300 mm, and a blow-off amount of an inert gas from an inner wall surface of the immersion nozzle is set to a value which falls within a range from 3 to 25 NL/min.

23. The method for manufacturing a steel sheet according to claim 2, wherein a hot-rolled steel sheet after pickling and before cold rolling is heated to a temperature higher than a steel sheet temperature immediately after the pickling is finished.

* * * * *